US011103895B2

(12) United States Patent
Freissle et al.

(10) Patent No.: US 11,103,895 B2
(45) Date of Patent: Aug. 31, 2021

(54) SCREENING SYSTEM FOR PORTABLE VIBRATORY MACHINE

(71) Applicant: Polydeck Screen Corporation, Spartanburg, SC (US)

(72) Inventors: Peter Helmut Franz Freissle, Spartanburg, SC (US); Mark Vincent Weaver, Landrum, SC (US)

(73) Assignee: Polydeck Screen Corporation, Spartanburg, SC (US)

( * ) Notice: Subject to any disclaimer, the term of this patent is extended or adjusted under 35 U.S.C. 154(b) by 90 days.

(21) Appl. No.: 16/157,278

(22) Filed: Oct. 11, 2018

(65) Prior Publication Data

US 2019/0039095 A1 Feb. 7, 2019

Related U.S. Application Data

(62) Division of application No. 15/271,293, filed on Sep. 21, 2016, now Pat. No. 10,315,226.

(60) Provisional application No. 62/221,286, filed on Sep. 21, 2015.

(51) Int. Cl.
*B07B 1/46* (2006.01)

(52) U.S. Cl.
CPC ..... *B07B 1/4645* (2013.01)

(58) Field of Classification Search
CPC ..... B07B 1/46; B07B 1/4645; B07B 2201/02
USPC ..... 209/399, 405, 409
See application file for complete search history.

(56) References Cited

U.S. PATENT DOCUMENTS

| | | | | |
|---|---|---|---|---|
| 4,065,382 | A | 12/1977 | Derrick, Jr. | |
| 4,661,245 | A | 4/1987 | Rutherford | |
| 4,819,809 | A | 4/1989 | Derrick | |
| 4,857,176 | A | 8/1989 | Derrick et al. | |
| 5,104,521 | A | 4/1992 | Rutherford | |
| 5,112,475 | A * | 5/1992 | Henry, Jr. | B07B 1/46 209/399 |
| 5,248,043 | A | 9/1993 | Dorn | |
| 5,277,319 | A | 1/1994 | Henry, Jr. | |
| 5,330,057 | A | 7/1994 | Schiller et al. | |

(Continued)

OTHER PUBLICATIONS

Unified Screening & Crushing "Removable Modular Systems" Specification Sheet, http://www.unifiedscreening.com/products/removable_modular_systems, accessed on Jul. 17, 2017—1 page, 2017.

(Continued)

*Primary Examiner* — Joseph C Rodriguez
(74) *Attorney, Agent, or Firm* — Dority & Manning, P.A.

(57) ABSTRACT

Apparatus, systems, and methods for providing a screening surface in a vibratory machine are provided. In one example embodiment, a screening system includes a plurality of bucker bar covers. Each bucker bar cover is adapted to fit over one of a plurality of bucker bars. Each bucker bar cover can have one or more recesses. The system further includes a plurality of panel fastening members (e.g., panel fastening straps, panel fastening shrouds, etc.). Each panel fastening member is adapted to extend across the plurality of bucker bar covers in one of the one or more recesses of the bucker bar covers. Each panel fastening member can have a fastening feature. The system can further include a plurality of screen panels. Each screen panel can have a fastening recess having a shape adapted to engage with the fastening feature of one of the panel fastening members.

14 Claims, 23 Drawing Sheets

(56) References Cited

U.S. PATENT DOCUMENTS

| | | | | |
|---|---|---|---|---|
| 5,346,053 | A | 9/1994 | Dorn | |
| 5,361,911 | A * | 11/1994 | Waites, Sr. | B07B 1/4645 209/399 |
| 6,000,556 | A | 12/1999 | Bakula | |
| 6,006,923 | A | 12/1999 | Helmy et al. | |
| 6,253,926 | B1 | 7/2001 | Woodgate | |
| 6,267,246 | B1 * | 7/2001 | Russell | B07B 1/4618 209/399 |
| 6,715,613 | B2 | 4/2004 | Eeles | |
| 6,736,271 | B1 | 5/2004 | Hall | |
| 7,296,685 | B2 | 11/2007 | Malmberg | |
| 7,467,715 | B2 | 12/2008 | Johnson | |
| 7,637,378 | B2 | 12/2009 | Malmberg | |
| 7,757,864 | B2 | 7/2010 | Barrett et al. | |
| 7,841,476 | B2 * | 11/2010 | Johnson | B07B 1/4645 209/405 |
| 7,959,009 | B2 * | 6/2011 | Weaver | B07B 1/4645 209/413 |
| 8,225,938 | B2 | 7/2012 | Malmberg | |
| 8,286,799 | B2 | 10/2012 | Malmberg | |
| 8,330,610 | B2 * | 12/2012 | Freissle | B07B 13/18 340/680 |
| 8,434,625 | B2 * | 5/2013 | Angus | B07B 1/42 209/405 |
| 8,505,737 | B2 | 8/2013 | Malmberg | |
| 8,800,779 | B2 | 8/2014 | Wardell | |
| 8,960,445 | B2 | 2/2015 | Malmberg | |
| 9,186,703 | B2 * | 11/2015 | Lane | B07B 1/4645 |
| 9,327,318 | B2 * | 5/2016 | Paul | B07B 1/46 |
| 9,375,757 | B2 * | 6/2016 | Wardell, Jr. | B07B 1/4645 |
| 9,795,992 | B2 * | 10/2017 | Woodgate | B07B 1/46 |
| 9,981,289 | B2 * | 5/2018 | Woodgate | B07B 1/4645 |
| 10,315,226 | B2 * | 6/2019 | Freissle | B07B 1/4645 |
| 2003/0042178 | A1 | 3/2003 | Robertson | |
| 2005/0224397 | A1 | 10/2005 | Malmberg | |
| 2008/0257791 | A1 | 10/2008 | Malmberg | |
| 2009/0050539 | A1 * | 2/2009 | Gronvall | B07B 1/4645 209/391 |
| 2009/0166268 | A1 | 7/2009 | Malmberg | |
| 2009/0301945 | A1 | 12/2009 | Trench | |

OTHER PUBLICATIONS

Sandvik Construction, "Making Waves—Sandvik WR Modular Screening Media," https://www.youtube.com/watch?v=CjaV22CU3Os, Posted on Jan. 27, 2014, Accessed on Jun. 26, 2017—1 page.

* cited by examiner

SCREENING SYSTEM FOR PORTABLE VIBRATORY MACHINE

PRIORITY CLAIM

The present application is a divisional of U.S. application Ser. No. 15/271,293 having a filing date of Sep. 21, 2016, which claims the benefit of U.S. Provisional Application Ser. No. 62/221,286 filed Sep. 31, 2015. Applicant claims priority to and the benefit of each of such applications and incorporate all such applications herein by reference in its entirety.

FIELD

The present disclosure relates generally to screening systems, and more particular to screening systems for vibratory machines, such as portable vibratory machines whose purpose is the processing of mined ore of various types, such as aggregate, coal, and various metals.

BACKGROUND

Woven wire systems have been used with vibratory machines for screening various materials. Woven wire systems typically have a steel or other metal woven wire mesh screen or wire cloth that is tensioned over a plurality of frame members (e.g., bucker bars) across the entire width of a vibratory machine. Replacement of the woven wire screen due to, for instance, damage and/or wear and tear, can require removal and replacement of the entire woven wire screen. This can be an expensive and time consuming process. Efforts have been made to replace woven wire systems with modular screening systems that allow for removal and replacement of single individual modular screen panels. However, such efforts have been difficult due to the excessive weight of frames that may need to be installed on the portable vibratory machine to accommodate the modular screen panels and due to need for structural modifications of the vibratory machine that may be undesirable.

SUMMARY

Aspects and advantages of embodiments of the present disclosure will be set forth in part in the following description, or may be learned from the description, or may be learned through practice of the embodiments.

One example aspect of the present disclosure is directed to a screening system for a portable vibratory machine. The vibratory machine has a plurality of bucker bars (e.g., frame members). The screening system includes a plurality of bucker bar covers. Each bucker bar cover is adapted to fit over one of the plurality of bucker bars of the portable vibratory machine The system further includes a plurality of panel fastening members (e.g., panel fastening shrouds, panel fastening straps, etc.). Each panel fastening member is adapted to extend across the plurality of bucker bar covers. The system further includes a plurality of screen panels. Each screen panel has a fastening recess having a shape adapted to engage with the fastening feature of one of the plurality of panel fastening members. The plurality of screen panels can be installed onto the panel fastening members to provide a screening surface for the portable vibratory machine.

Another example aspect of the present disclosure is directed to a screen panel for use in a screening system for a vibratory machine. The screening system can have a plurality of panel fastening members extending across one or more bucker bars of a vibratory machine. Each panel fastening member can have a fastening feature. The screen panel can include a plurality of edge members forming a peripheral frame and a screening surface extending between the plurality of edge members. The screen panel can further include a fastening recess along at least a portion of one of the edge members. The screen panel can further include a thin portion defined between an edge of the peripheral frame and the fastening recess. The fastening recess can have a shape adapted to engage with a fastening feature of the panel fastening member extending across the vibratory machine.

Yet another example aspect of the present disclosure is directed to a method for installing a screening system for a vibratory machine. The method includes placing a bucker bar cover on a bucker bar of the vibratory machine and placing a panel fastening strap across the bucker bar cover. The method further includes securing the panel fastening strap to a clamp bar assembly and securing the clamp bar assembly to the vibratory machine. The method further includes installing one or more screen panels to the panel fastening strap.

Other example aspects of the present disclosure are directed to systems, methods, apparatus for screening material.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
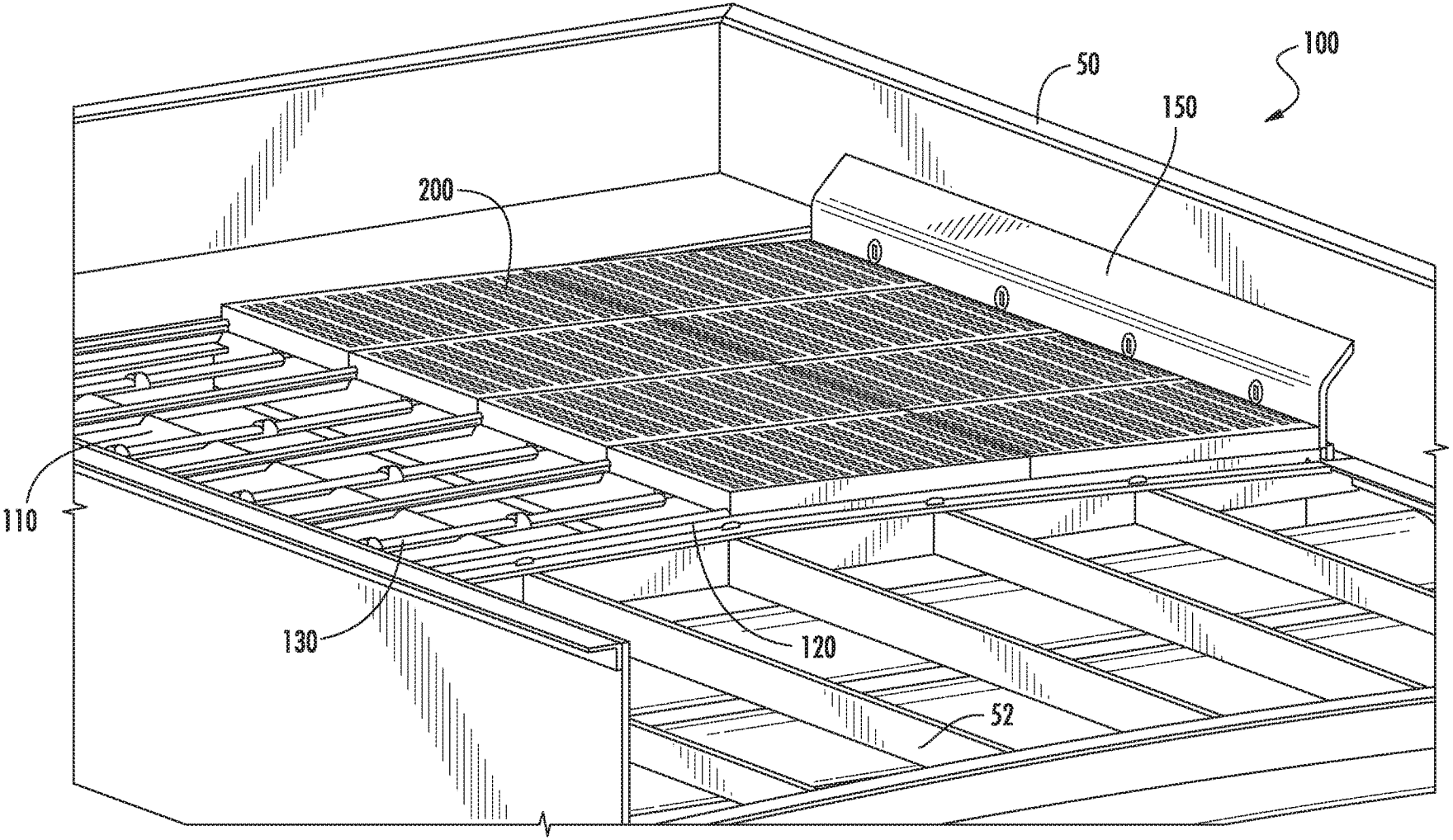
FIG. 1 depicts a perspective view of an example screening system according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to screening systems for use in, for instance, a portable or permanently installed vibratory machine. More particularly, a screening system that accommodates modular screening media, such as modular screen panels, can be installed and/or retrofit into a vibratory machine without requiring modification of a frame portion of a vibratory machine. The modular screen panels can be made from a resilient material, such as polyurethane or rubber. Once an individual screen panel has become worn, the individual screen panel can be replaced with a new screen panel without having to replace all screen panels across the entire screening surface of the vibratory machine. In this way, screening systems according to example aspects of the present disclosure can provide for the ability to convert standard woven wire systems installed on vibratory machines to a modular screening system without having to make modifications (e.g., cutting and/or welding) to the frame (e.g., bucker bars) of the vibratory machine.

According to particular aspects of the present disclosure, once a woven wire screen mesh has been removed from the vibratory machine, bucker bar covers can be installed to fit over frame members (e.g., bucker bars) of the vibratory machine. In some embodiments, the bucker bars can have differing heights to form an arc across the width of the vibratory machine. Panel fastening members can be installed across the bucker bar members. Screen panels can be secured to the panel fastening members to provide a screening surface for the vibratory machine.

For instance, in some embodiments, panel fastening shrouds made of a resilient material (e.g., rubber or polyurethane) can be installed across the bucker bar covers. The panel fastening shrouds can have tube made of metal (e.g., steel) or other suitable material that can receive cables threaded through the panel fastening shrouds. The panel fastening shrouds can be tensioned over the bucker bar covers by securing the cables to a clamp bar assembly located along the sides of the portable vibratory machine and securing the clamp bar assembly to the portable vibratory machine using threaded fasteners or other means of securing.

Once the clamp bar assembly with cables are installed in the vibratory machine, the screening system can provide precisely located fastening features located along the panel fastening shrouds that allow screen panels to be installed in the screening system in modular fashion. The panel fastening shrouds can include a panel fastening feature configured to engage with screen panels to fasten the screen panels to the screening system. The panel fastening feature can be a rail fastening feature configured to cooperate and/or engage with a complimentary fastening recess formed along a length of an edge member of a screen panel to be installed in the screening system. In some embodiments, the panel fastening feature can include a lateral retention feature located proximate to the fastening feature. The lateral retention feature can include, for instance, one or more of a lateral retention protrusion and a lateral retention recess configured to cooperate with complimentary recesses/protrusions formed in an edge member of a screen panel to be installed in the screening system.

In other embodiments, panel fastening straps can be installed across the bucker bar covers. The panel fastening straps can be formed at least in part of a metal (e.g., steel) strap component that extends across the vibratory machine. The panel fastening strap can further include a molded component formed from, for instance, a resilient material (e.g., rubber or polyurethane) that can include a panel fastening feature configured to engage with screen panels to fasten the screen panels to the screening system. The panel fastening feature can be a rail fastening feature configured to cooperate and/or engage with a complimentary fastening recess formed along a length of an edge member of a screen panel to be installed in the screening system. The panel fastening straps can be tensioned over the bucker bar covers by securing the straps to a clamp bar assembly located along the sides of the portable vibratory machine and securing the clamp bar assembly to the vibratory machine using a suitable mechanical coupling (e.g. nut and bolt, etc.).

Once the clamp bar assembly is installed in the vibratory machine, the panel fastening straps can provide precisely located fastening features located along the panel fastening straps that allow screen panels to be installed in the screening system in modular fashion. In some embodiments, the panel fastening feature can include a lateral retention feature located proximate to the fastening feature. The lateral retention feature can include, for instance, one or more of a lateral retention protrusion and a lateral retention recess configured to cooperate with complimentary recesses/protrusions formed in an edge member of a screen panel to be installed in the screening system.

The screen panels to be installed in the screening systems according to example embodiments of the present disclosure can be formed from a resilient material, such as rubber or polyurethane. The screen panels can include a fastening recess disposed along a portion of a length of an edge member of the screen panel. The fastening recesses can be configured to cooperate and/or engage with the panel fastening feature of the panel fastening shrouds or panel fastening straps. In some embodiments, the screen panel can further include a lateral retention recess and/or lateral retention groove located proximate to the fastening recess that can be engaged with a lateral retention feature located on the panel fastening shrouds or panel fastening straps.

In some embodiments, the screen panels can further include an insert (e.g., a stamped steel insert) that allows for thin panel cross sections at the panel fastening feature of the screen panel to improve open area for the screen panel. The insert can allow the screen panel to maintain stiffness in a length direction from fastening edge to fastening edge while allowing for easy deformation of the panel along the width direction to follow the arc formed by the bucker bars of the portable vibratory machine.

In some embodiments, the screening system can further include one or more panel locating members. The locating members can be locating shrouds that can be tensioned across the bucker bar covers. Similar to the panel fastening shrouds, the panel locating shrouds can similarly include a tube configured to receive a cable threaded through the panel locating shroud. The cable can be secured to the clamp bar assembly to tension the panel locating shroud across the portable vibratory machine. The panel locating shrouds can include locating features (e.g., one or more protrusions of any suitable geometry) configured to assist with locating and securing screen panels into the screening system. In other embodiments, the panel locating members can be panel locating straps having a metal strap portion and a molded portion of, for instance, rubber or polymeric materials (e.g., polyurethane).

In some embodiments, the screen panel can include locating recesses configured to cooperate and/or engage with locating features of the panel locating shroud to assist with locating and securing the screen panel in the screening system. The locating recesses can be formed in the screen panel and can be located on the underside of the side members of the screen panel and/or one or more supporting ribs of the screen panel that run perpendicular to or nearly perpendicular to the edge members of the screen panel. The locating recesses can extend across a limited span of an underside of a side member and/or one or more rib portions or substantially across an entire length of a side member and/or one or more rib portions.

FIG. 1 depicts a perspective view of an example screening system 100 installed on a vibratory machine 50. The screening system 100 can be installed or retrofit into the vibratory machine 50 without requiring modification of a frame portion of the vibratory machine 50. For instance, a woven wire mesh can be removed from the vibratory machine 50. Bucker bar covers associated with the woven wire mesh can also be removed. The screening system 100 can be installed into the vibratory machine 50. The screening system 100 can accommodate modular screen panels 200 to provide a modular screening system.

The screening system 100 includes a plurality of bucker bar covers 110, a plurality of panel fastening shrouds 120, a clamp bar assembly 150, and a plurality of screen panels 200. The panel fastening shrouds 120 can provide fastening features at regularly spaced intervals for fastening the screen panels 200 to the screening system 100. In some embodiments, the screening system 100 can include panel locating shrouds 130 to facilitate locating and securing the screen panels 200 to the screening system 100. The screen panels 200 can have a screening surface and can be used to separate and size material. The screen panels 200 can be made of or can include any suitable material, such as a resilient material (e.g., rubber or polymeric material such as polyurethane). The screen panels 200 can be modular screen panels.

As shown in FIG. 1, the bucker bar covers 110 are installed to fit over the bucker bars 52 of the vibratory machine 50. The panel fastening shrouds 120 extend over the bucker bar covers in a generally perpendicularly direction relative to the bucker bar covers 110. Cables in the panel fastening shrouds 120 can be secured to clamp bar assembly 150 to tension the panel fastening shrouds 120 in the screening system. The screen panels 200 can then be installed in the system 100 using fastening features (e.g., rails) located on the panel fastening shrouds 120

Figure 2:
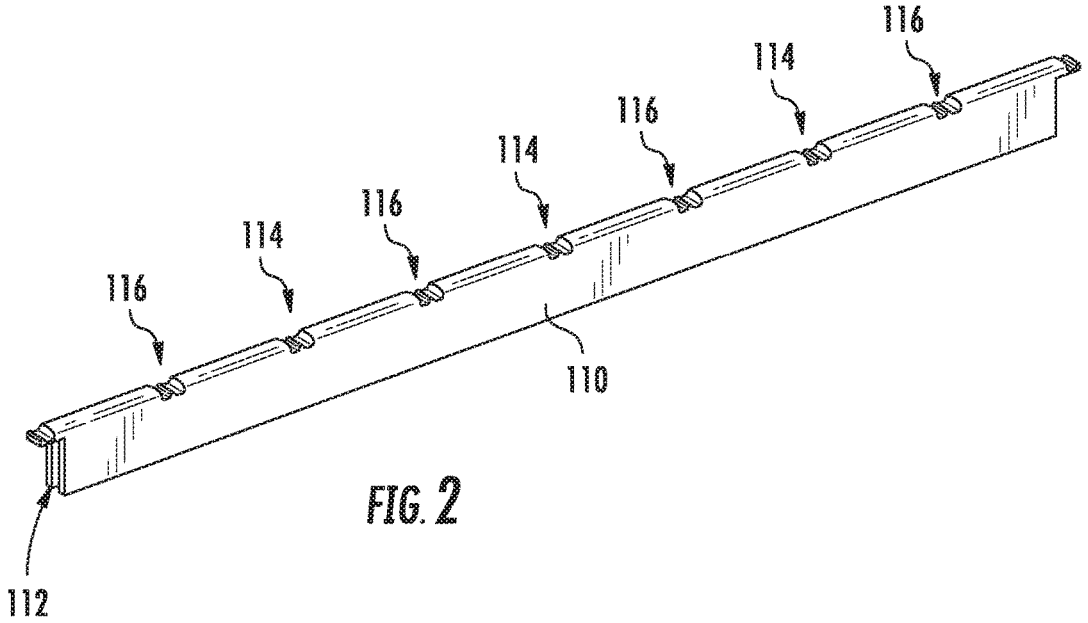
FIG. 2 depicts a perspective view of an example bucker bar cover according to example embodiments of the present disclosure.

FIG. 2 provides a perspective view of an example bucker bar cover 110 according to example embodiments of the present disclosure. The bucker bar cover 110 can be made of any suitable material, such as rubber, polymeric material such as polyurethane, or other material. As shown, the bucker bar cover 110 has a slot having a size and shape adapted to fit over or receive a bucker bar of a vibratory machine. In addition, the bucker bar cover 110 can include fastening shroud recesses 114 at regularly spaced intervals along a length of the bucker bar cover 110. The fastening shroud recesses 114 can be designed to accommodate a portion of panel fastening shroud 120 according to example embodiments of the present disclosure. The spacing between the fastening shroud recesses 114 can be precisely determined to provide regular spacing of the panel fastening shrouds 120 in the screening system 100 at a desired interval to accommodate dimensions of the screen panels.

As will be discussed in further detail below, the screening system can, in some embodiments, additionally include panel locating shrouds 130. In these embodiments, the bucker bar cover 110 can further include locating shroud recesses 116 spaced at regular intervals along the length of the bucker bar cover 110. The locating shroud recesses 116 can be spaced between the fastening shroud recesses 120. The spacing between the fastening shroud recesses 114 can be precisely determined to provide regular spacing of the panel fastening shrouds 120 in the screening system 100 at a desired interval to accommodate dimensions of the screen panels.

Figure 3:
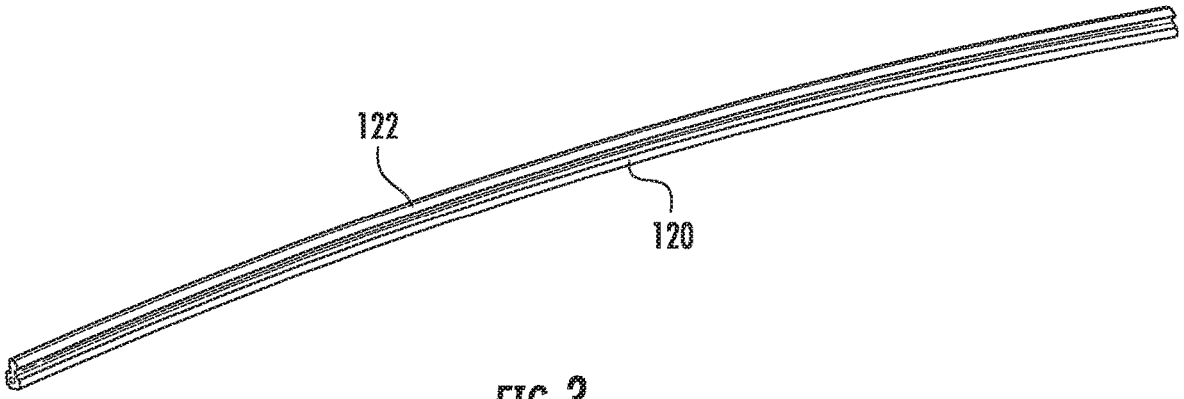
FIG. 3 depicts a perspective view of an example panel fastening shroud according to example embodiments of the present disclosure.

FIG. 3 depicts a perspective view of an example panel fastening shroud 120 according to example embodiments of the present disclosure. The panel fastening shroud 120 can include a fastening feature 122, such as a rail fastening feature, that can be used to secure screen panels 200 to the screening system 100. The panel fastening shroud 120 can be made of any suitable material, such as rubber, polymeric material such as polyurethane, or other material. The fastening feature 122 may or may not be continuous over the length of the panel fastening shroud 120

Figure 4:
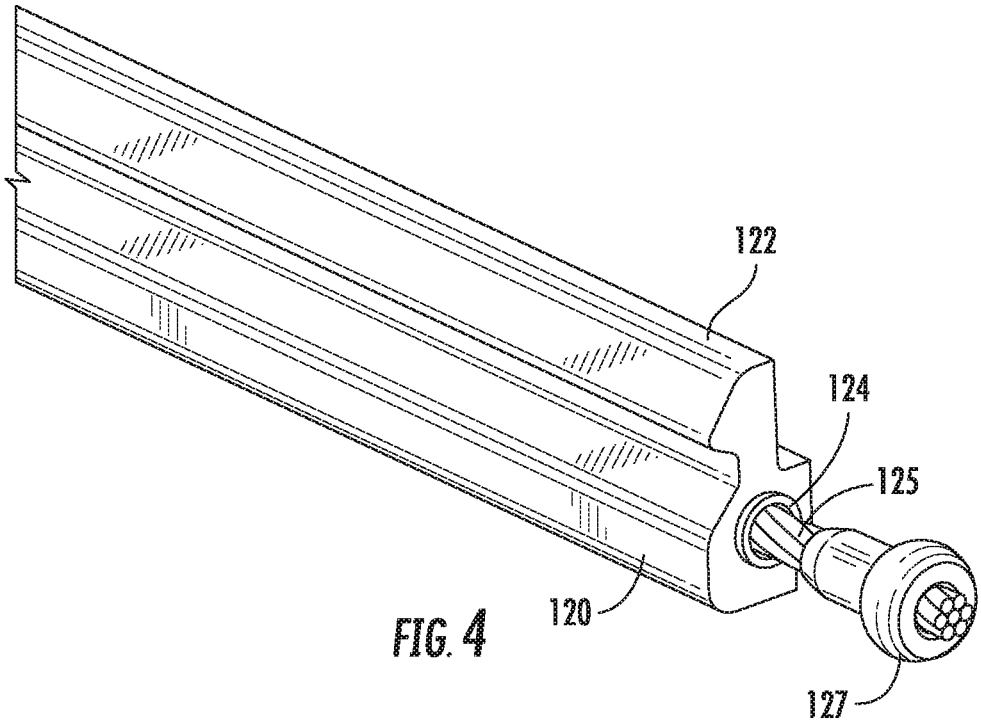
FIG. 4 depicts a close up perspective view of a portion of an example panel fastening shroud according to example embodiments of the present disclosure.

FIG. 4 depicts a close up perspective view of an example panel fastening shroud 120 according to example embodiments of the present disclosure. As shown, the panel fastening shroud 120 has a panel fastening feature 122. In this example, the panel fastening feature 122 is a rail fastening feature having a protrusion extending along a length of the panel fastening shroud 120. The protrusion of the panel fastening feature 122 can have any suitable geometry. Those of ordinary skill in the art, using the disclosures provided herein, will understand that other panel fastening features can be used without deviating from the scope of the present disclosure.

The panel fastening shroud 120 can include a tube insert 124. The tube insert 124 can receive a cable 125. The cable 125 can extend through the length of the panel fastening shroud 120 through the tube insert 124. The tube insert 124 can protect the panel fastening shroud 120 from wear and/or other damage or modifications resulting from cable 125. The cable 125 can include a ferrule 127. The tube insert 124 can also allow for insertion of the cable 125 after the panel fastening shroud 120 has been manufactured. The panel fastening shroud 120 can have sufficient flexibility to follow the contour of the arc formed by the differing heights of the bucker bars of the vibratory machine. The panel fastening shroud 120 can also serve to protect the cable 125 from wear during use of the screening system 100. The panel fastening shroud 120 can also be configured to accommodate more than one cable 125 without deviating from the scope of the present disclosure, such as two cables or other suitable number of cables.

Figure 5:
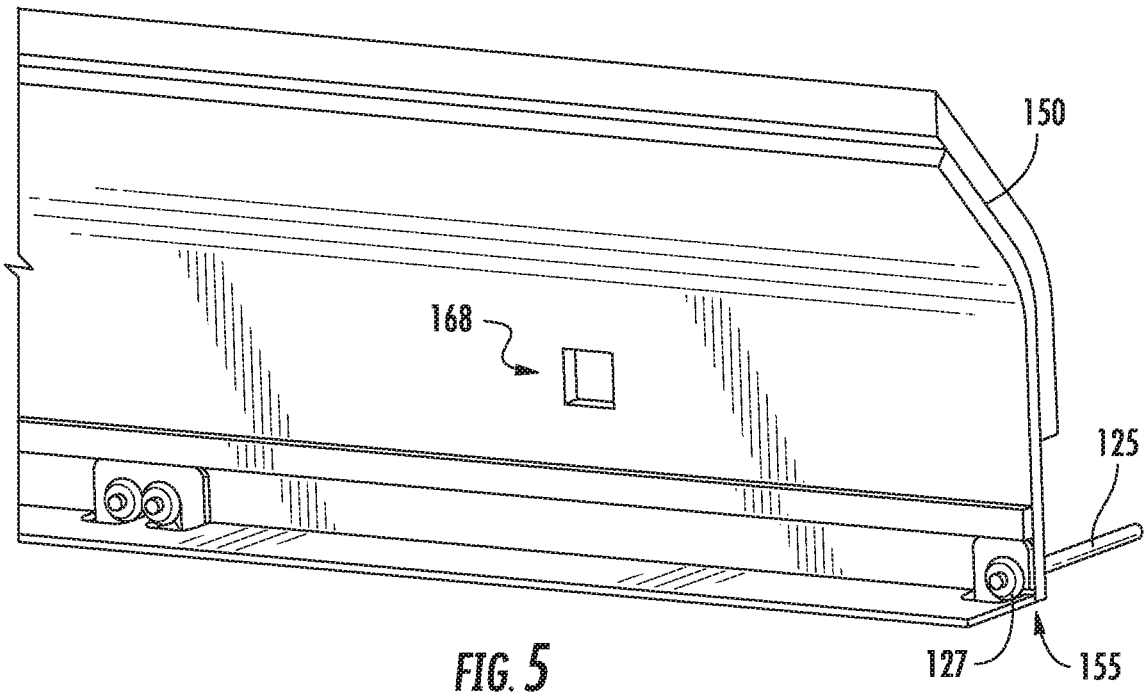
FIG. 5 depicts an example clamp bar assembly according to example embodiments of the present disclosure.

As shown in FIG. 5 the ferrule 127 can cooperate with a suitable aperture 155 formed in the clamp bar assembly 150 to secure the cable 125 to the clamp bar assembly. The clamp bar assembly 150 can be secured (e.g., through bolts or other components extending through aperture 155) to a sidewall of a vibratory machine to tension the cables 125 and the panel fastening shrouds 120.

FIG. 4 depicts a panel fastening shroud 120 having a single fastening feature 122 for engagement with a single screen panel 200. The panel fastening shroud 120 can be installed immediately adjacent to or abutting with another panel fastening shroud 120 so that screen panels 200 can be installed adjacent to one another. In other example embodiments, the panel fastening shroud 120 can have two fastening features 122. The fastening features 122 can be mirror images of one another and spaced apart to accommodate the fastening recesses of two adjacent screen panels 200.

Figure 6:
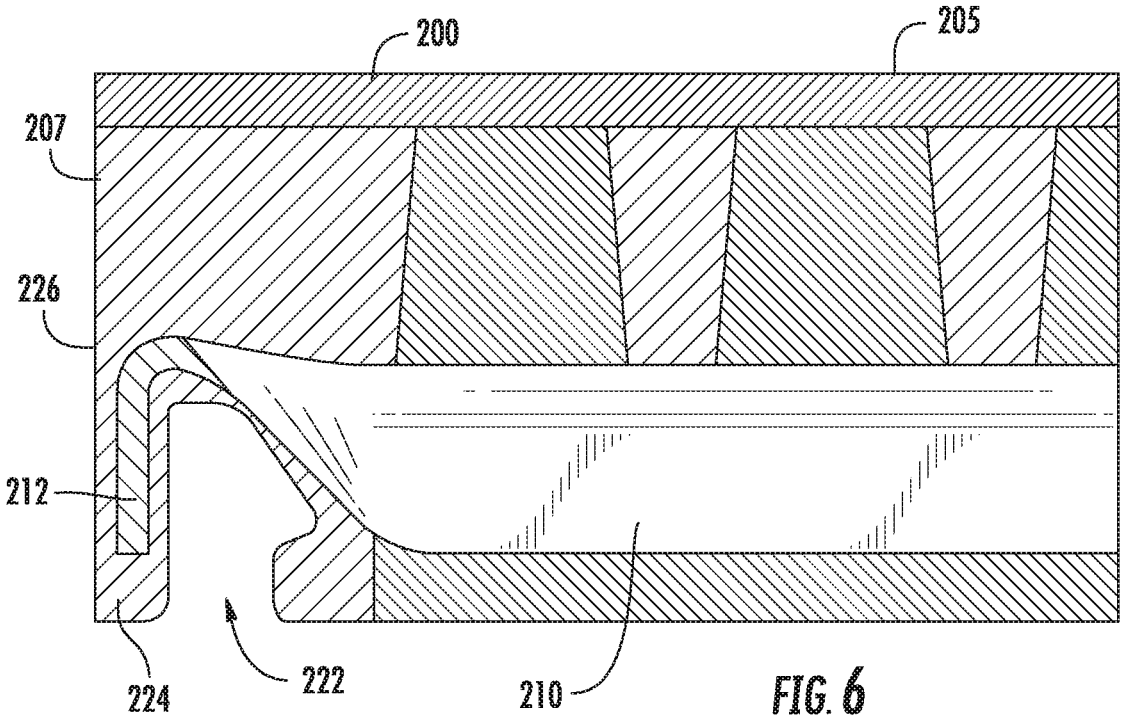
FIG. 6 depicts a cross-sectional view of a portion of an example screen panel according to example embodiments of the present disclosure.

FIG. 6 depicts a cross-sectional view of a portion of an example screen panel 200 having a screening surface 205 extending between a peripheral frame 207 according to example embodiments of the present disclosure. As shown, the example screen panel 200 can include a fastening recess 222 that extends along a length of an edge member of the screen panel 200 that cooperates and/or engages the fastening feature 122 of the panel fastening shroud 120 to secure the screen panel 200 to the system 100. The size and shape of the recess 222 can be configured to receive the fastening feature 122 of the panel fastening shroud 120.

To provide increased open area (e.g., an increased screening surface) of the screen panel 200, the screen panel 200 can include a relatively thin portion 224 between an edge 226 of the screen panel 200 and the fastening recess 222. To provide increased structural strength to the thin portion 224, the screen panel 200 can include one or more inserts 210 (e.g., a steel or other suitable material insert) in the support ribs of the screen panel 200. The one or more inserts 210 can each includes a lip portion 212 that extends at least partially into the thin portion 224 of the screen panel 200 between the edge 226 of the screen panel 200 and the fastening recess 222. The lip portion 212 can provide increased strength to thin portion 224 to facilitate securing the screen panel 200 to the panel fastening shroud 120. The insert 210 can also facilitate maintaining screen stiffness in a length direction while allowing flexibility to conform to the arc defined by the differing heights of the bucker bars in the width direction.

Figure 7:
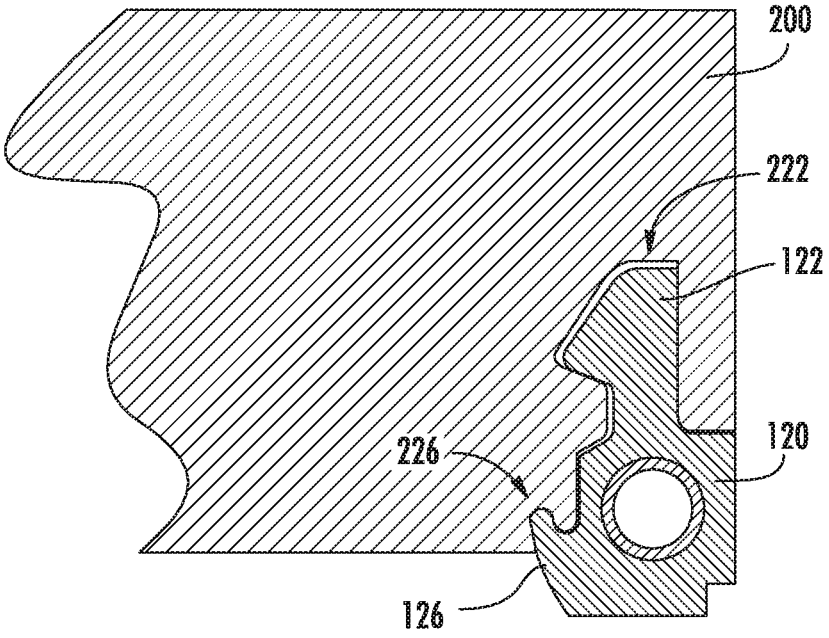
FIG. 7 depicts a side view of a portion of an example screen panel being fastened to a panel fastening shroud according to example embodiments of the present disclosure.

FIG. 7 depicts the example engagement of a screen panel 200 to a panel fastening shroud 120 according to example embodiments of the present disclosure. As shown, the fastening feature 122 of the panel fastening shroud 120 is received into the fastening recess 222 of the screen panel 200. In the example embodiment of FIG. 7, the panel fastening shroud 120 further includes a lateral retention feature 126. The lateral retention feature 126 can include a recess and a protrusion that is smaller in dimension relative to the fastening feature 122. The lateral retention feature 126 can extend across a length of the panel fastening shroud 120 or across a portion of the length of the panel fastening shroud 120. In addition, the panel fastening shroud can include multiple lateral retention features 126 spaced apart across the length of the panel fastening shroud 120.

The screen panel 200 can include a lateral retention feature 226 that can cooperate or be engaged with the lateral retention feature 126 on the panel fastening shroud 120. The lateral retention feature 226 can include one or more of a recess and a groove that is smaller in dimension than the fastening recess 222 and has a shape and geometry configured to cooperate with the lateral retention feature 126. In some embodiments, the lateral retention feature 120 can reduce lateral movement of the screen panel 200 in the screening system 100 during use.

Figure 8:
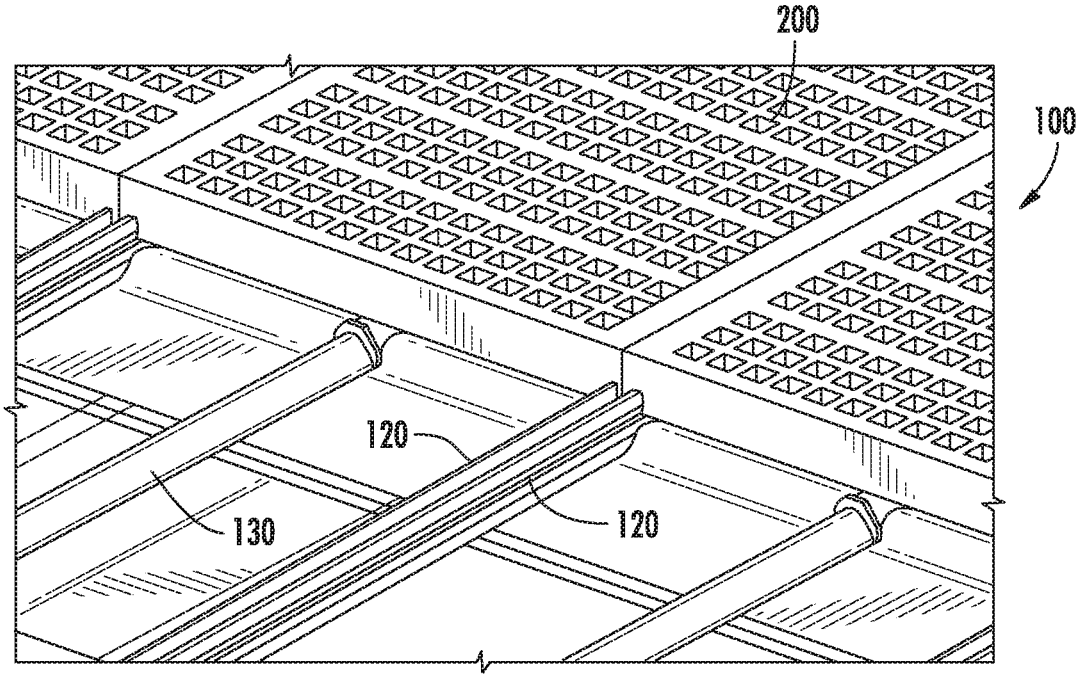
FIG. 8 depicts a perspective view of a portion of an example screening system according to example embodiments of the present disclosure.

FIG. 8 depicts a perspective view of a portion of an example screening system 100. As shown, the system 100 can include two panel fastening shrouds 120 installed adjacent to one another so as to accommodate installing two panels 200 adjacent to one another.

In some embodiments, the screening system 100 can additionally include one or more panel locating shrouds 130 as demonstrated in FIG. 8. The panel locating shrouds 130 can cooperate with locating recesses defined in the screen panels 200 to facilitate locating and securing the screen panels 200 to the screening system 100. The panel locating shrouds 130 can have cables extending through the length of the panel locating shrouds 130. The cables can be secured to the clamp bar assembly 150 to tension the panel locating shrouds 130 over the bucker bar covers 110.

Figure 9:
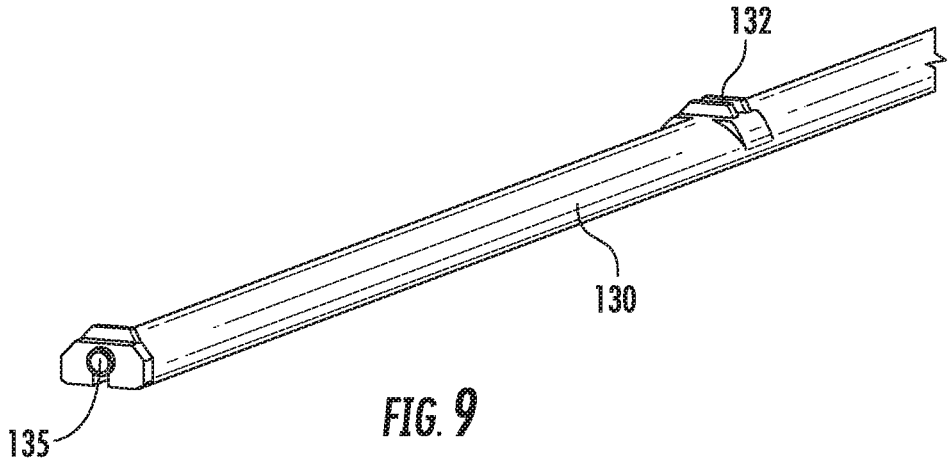
FIG. 9 depicts a perspective view of a portion of an example panel locating shroud according to example embodiments of the present disclosure.

FIG. 9 depicts a perspective view of a portion of an example panel locating shroud 130 according to example embodiments of the present disclosure. The panel locating shroud 130 can be made of any suitable material, such as rubber, polymeric material such as polyurethane, or other material. As shown, the panel locating shroud 130 can include locating features 132 that can cooperate with locating recesses defined in screen panels 200 to facilitate locating and securing the screen panels 200 to the screening system 100. The locating features 132 can be protrusions having any suitable geometry. Those of ordinary skill in the art, using the disclosures provided herein, will understand that other locating features 132 can be used without deviating from the scope of the present disclosure.

The panel locating shroud 130 can include a tube insert 135. The tube insert 135 can receive a cable. The cable can extend through the length of the panel locating shroud 130 through the tube insert 135. The tube insert 135 can protect the panel locating shroud 130 from wear and/or other damage or modifications resulting from the cable. The tube insert 135 can also allow for insertion of the cable after the panel locating shroud 130 has been manufactured. The panel locating shroud 130 can have sufficient flexibility to follow the contour of the arc formed by the differing heights of the bucker bars of the vibratory machine. The panel locating shroud 130 can also serve to protect the cable from wear during use of the screening system 100.

Figure 10:
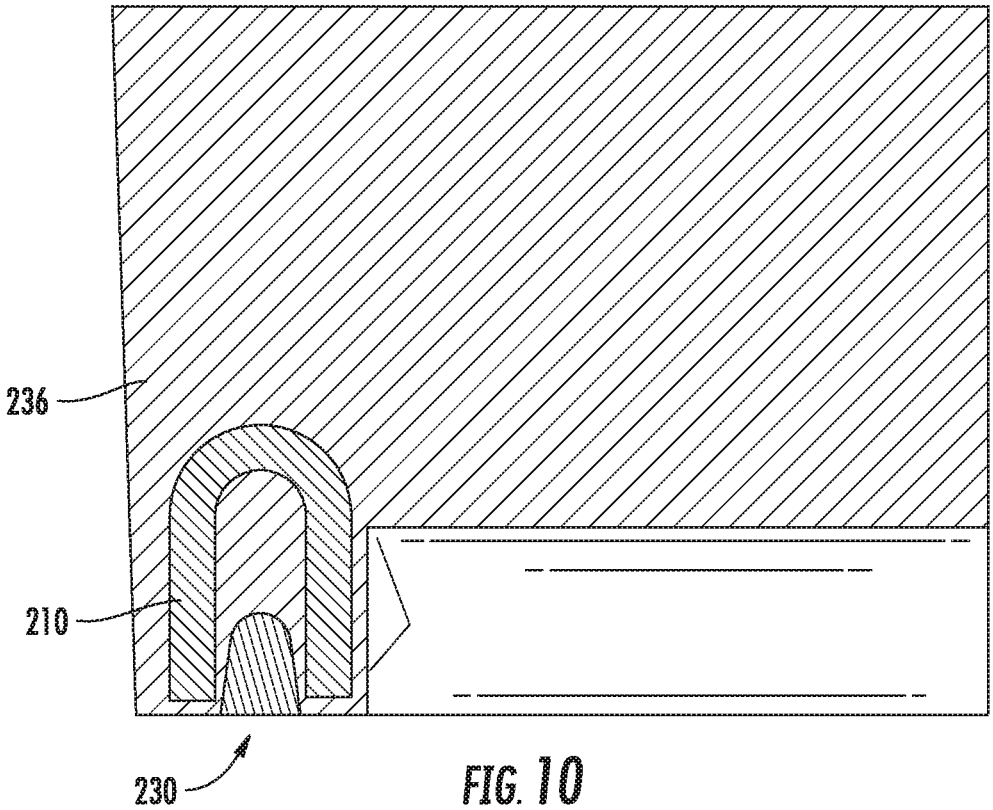
FIG. 10 depicts a cross-sectional view of a portion of an example screen panel having a locating recess having a size and shape adapted to engage a panel locating shroud according to example embodiments of the present disclosure.
Figure 11:
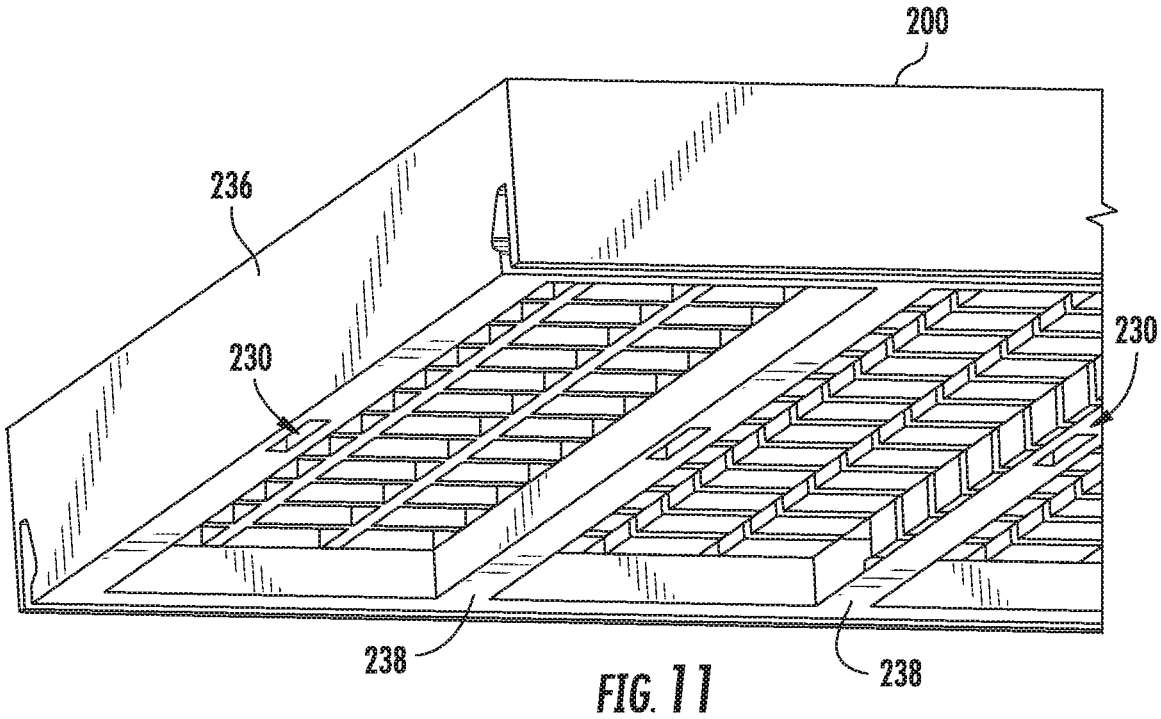
FIG. 11 depicts a perspective view of a portion of an example screen panel having a locating recess having a size and shape adapted to engage a panel locating shroud according to example embodiments of the present disclosure.

As shown in FIGS. 10 and 11, the screen panel 200 can include one or more locating recesses 230 defined in underside of the side members and/or one or more support ribs of the screen panel 200. FIG. 10 shows a cross-sectional view of a locating recess 230 relative to an insert 210 installed on the underside of a side member 236 of the screen panel 200. As shown, the insert 210 has a U-shaped profile to accommodate the locating recess 230 in the side member 236 of the screen panel.

FIG. 11 depicts an underside of the screen panel 200. As shown, a locating recess 230 is defined on the underside of side member 236. In addition, the screen panel includes locating recesses 230 defined in the underside of the support ribs 238. The locating recess 230 in FIG. 11 spans a limited width of the side member 236 of the screen panel 200. More particularly, the span of the locating recess 230 is less than 20% of the span of the side member 236. In other embodiments, the span of the locating recess 230 can extend substantially across the entire span of the side member 236 (e.g., more than 60% across the span of the side member 236.

Figure 12:
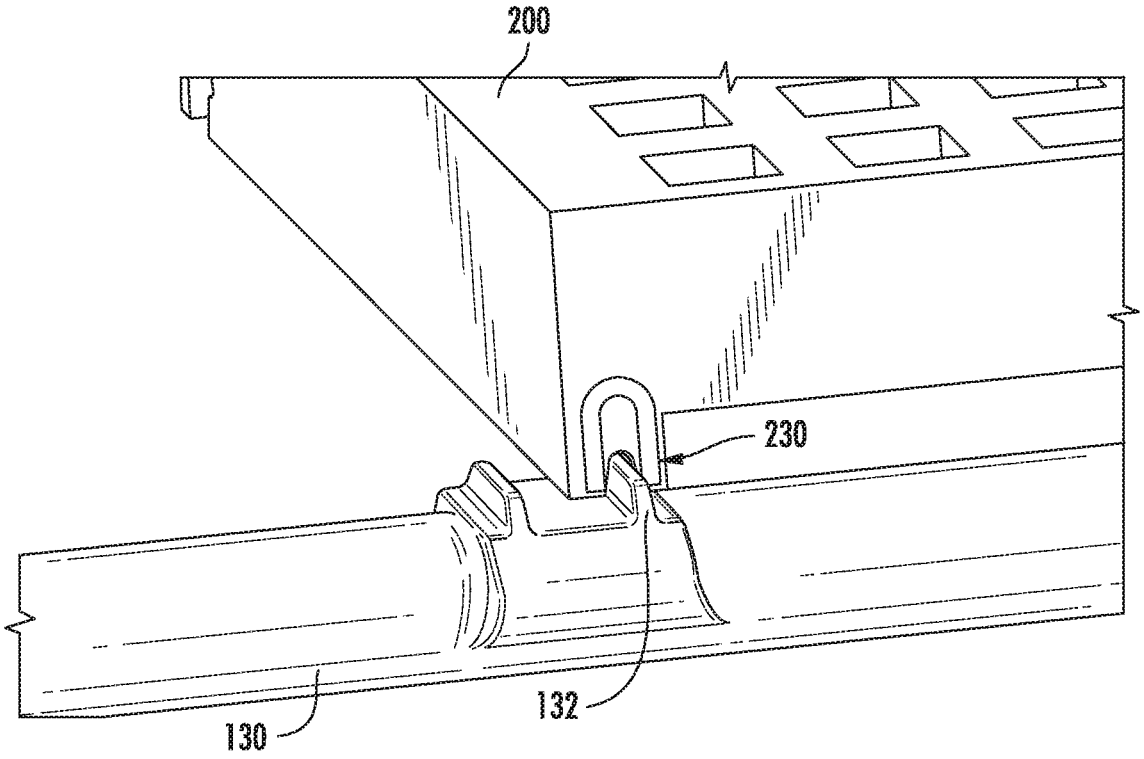
FIG. 12 depicts a perspective view of a portion of an example screen panel engaged with a panel locating shroud according to example embodiments of the present disclosure.

As shown in FIG. 12, the locating recess 230 defined on the underside of the screen panel 200 can receive the locating feature 132 defined in the panel locating shroud 130. Aligning the locating recess 230 of the screen panel 200 with the locating feature 132 of the panel locating shroud 130 can facilitate locating and securing the screen panel 200 in the screening system 100.

Figure 13:
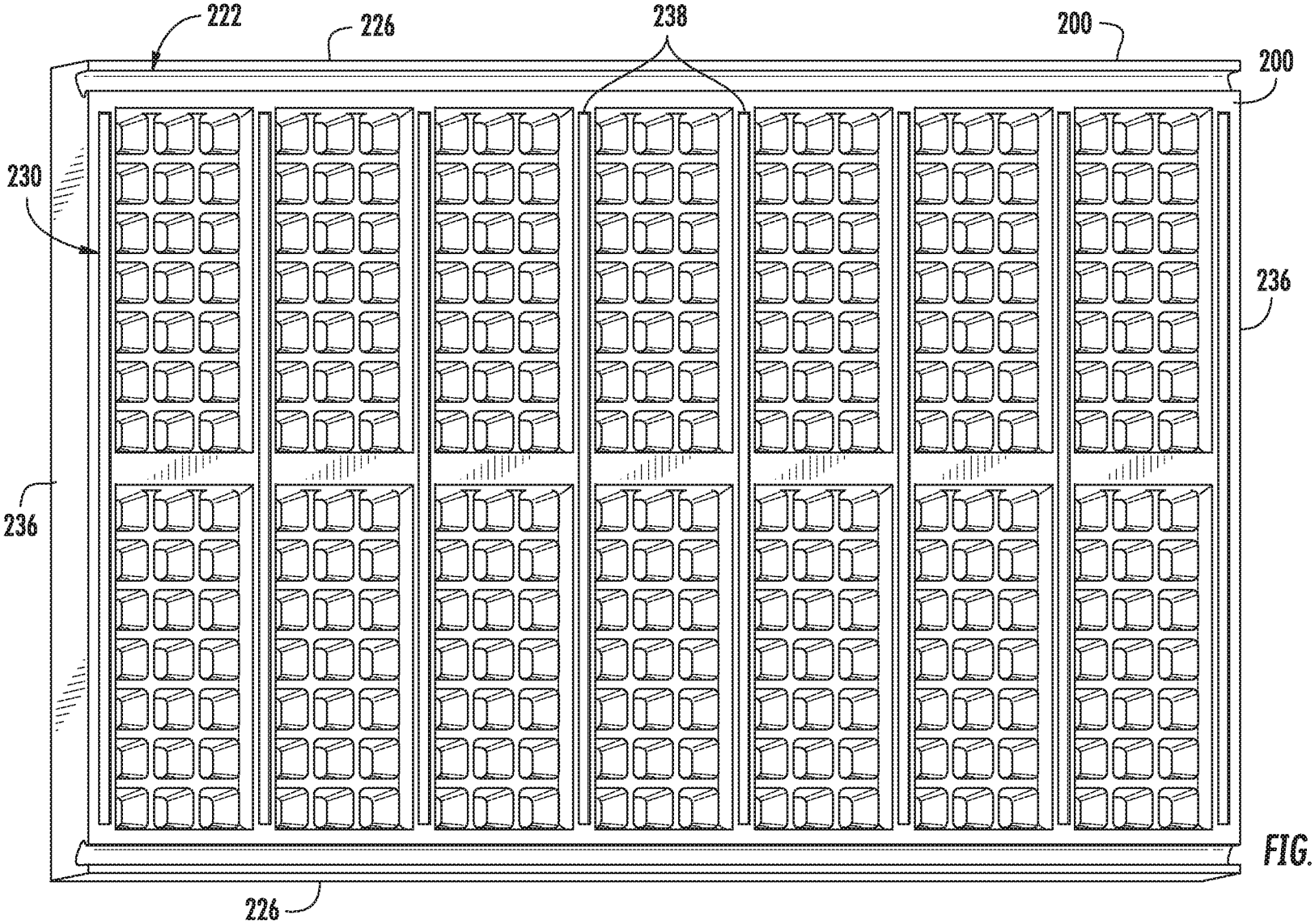
FIG. 13 depicts a perspective view of a bottom portion of an example screen panel according to example embodiments of the present disclosure.

FIG. 13 depicts a perspective view of an example screen panel 200 according to example aspects of the present disclosure. The screen panel 200 can include a peripheral frame having a pair of opposing edge members 226 and a pair of opposing side members 236 defining an opening 240. A plurality of screening ribs 142 can extend across the opening 140 to define a screening surface. The shape, size, and spacing the screening ribs 142 can have a variety of configurations and can be selected to size and sort various materials depending on the particular application. The screen panel can include support ribs 238 to support the screening ribs 242.

The screen panel 200 includes a fastening recess 222 defined in each of the edge members 226. The fastening recess 222 has a shape and configuration adapted to cooperate with a fastening feature defined in a panel fastening shroud according to example embodiments of the present disclosure. The screen panel 200 further includes a locating recess 230 in each of the side members 236. The locating recess 230 has a span that extends substantially across the span of the side member 236. In addition, the screen panel 200 has a locating recess 230 in one or more of the support ribs 238. Each locating recess 230 has a shape and configuration adapted to cooperate with a locating feature defined in a panel locating shroud according to example embodiments of the present disclosure.

In example embodiments, the screening panels as described herein may be made of suitable material. For example, in various embodiments, the material may be formed of a resiliently deformable material. For example, in various embodiments, the resiliently deformable material may be a resiliently deformable polymeric material. In certain embodiments, the resiliently deformable material may include polyurethane. Further, in certain embodiments, the resiliently deformable material may include rubber. However, it should be understood that the present disclosure is not limited to the above disclosed materials. Rather, any suitable polymeric material or resiliently deformable material is within the scope and spirit of the present disclosure. Further it should be understood that the various components of the screening panel, such as the screening ribs and/or the support ribs, need not be formed of the same material, but rather may be formed from varying materials having varying desirable resilience characteristics. In some embodiments, the screening surface can include a metal mesh or screening area. The metal mesh or screening area can have a perimeter made of a resiliently deformable material.

In addition, the screening panel material may, in certain embodiments, have a Shore hardness in the range from approximately 40 Shore A to approximately 90 Shore A. In other embodiments, the screening panel material may have a Shore hardness in the range from approximately 60 Shore A to approximately 85 Shore A. However, it should be understood that the screening panel material of the present disclosure is not limited to Shore hardnesses in the range from approximately 40 Shore A to approximately 90 Shore A or approximately 60 Shore A to approximately 85 Shore A, but may be a material with any hardness above or harder than 90 Shore A or below or softer than 40 Shore A. Further it should be understood that the various components of the screening panel, such as the screening ribs and/or the support ribs, need not be formed of the same material, but rather may be formed from varying materials having varying desirable hardnesses.

Figure 14:
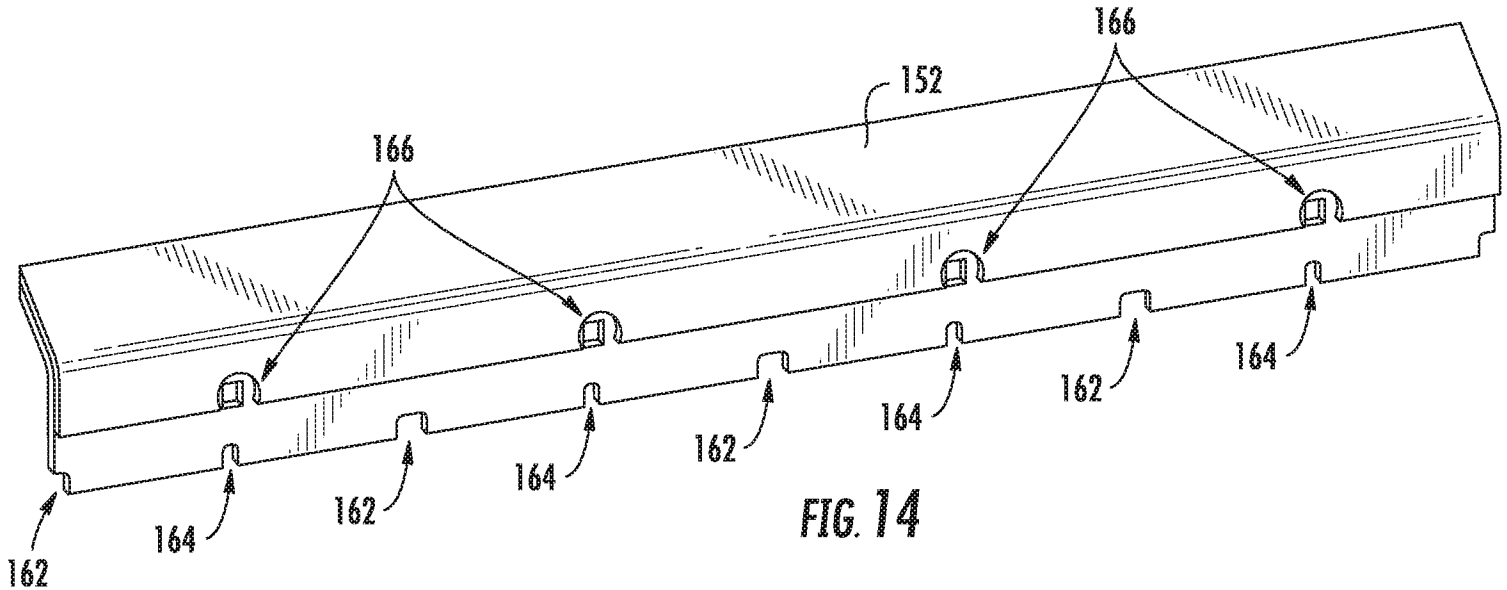
FIG. 14 depicts a perspective view of an example clamp bar according to example embodiments of the present disclosure.
Figure 15:
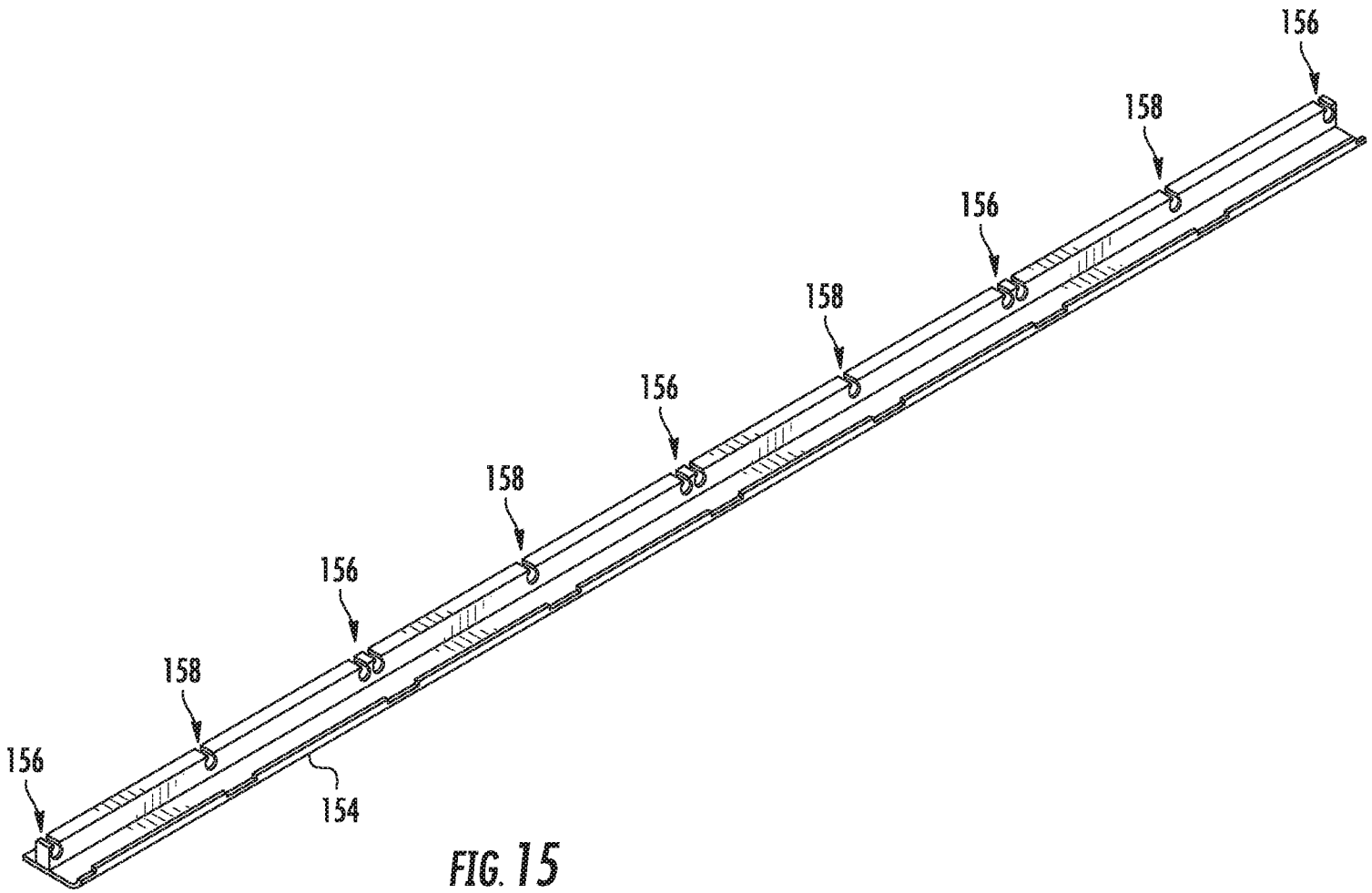
FIG. 15 depicts a perspective view of an example cable termination bar according to example embodiments of the present disclosure.
Figure 16:
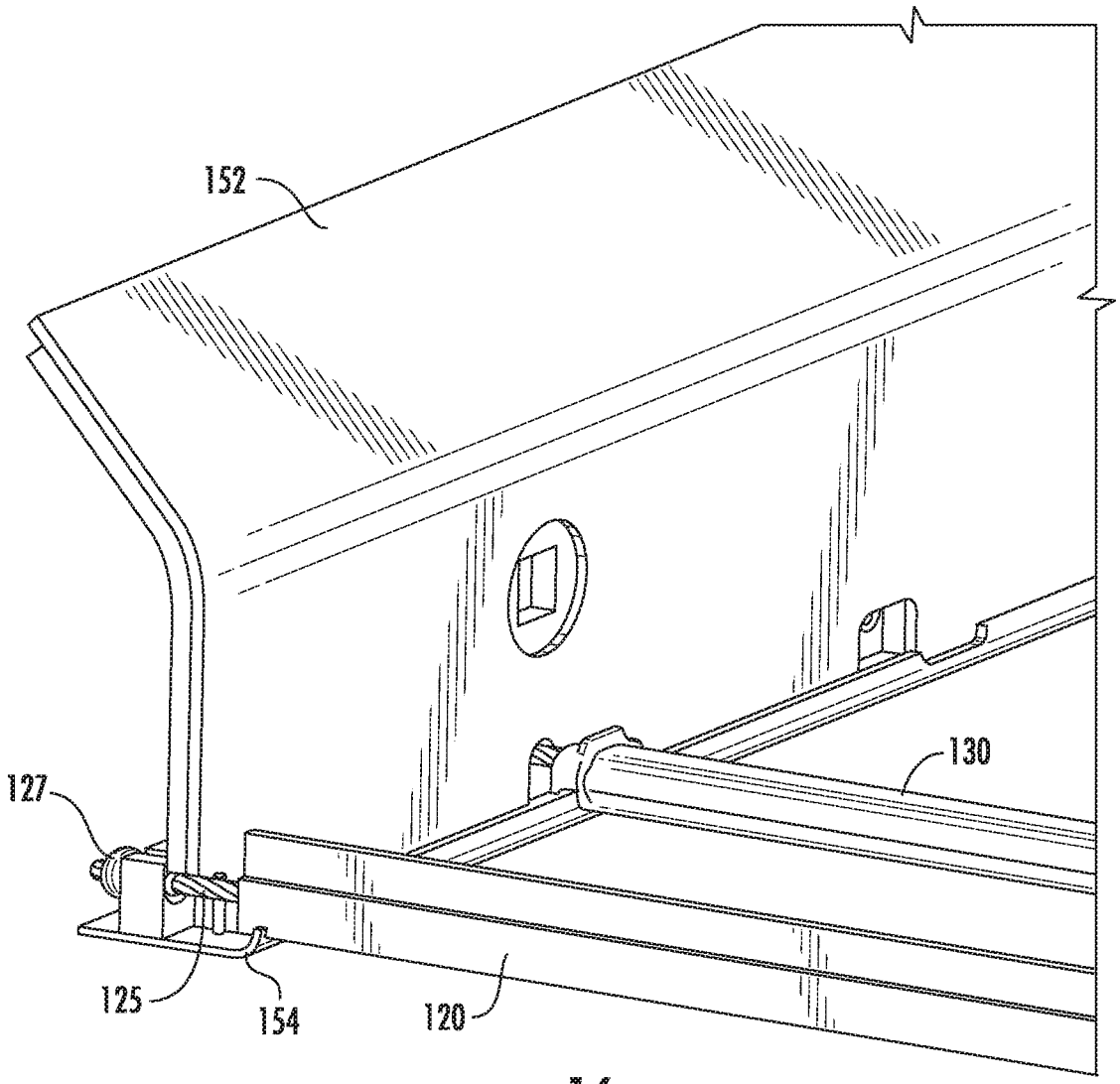
FIG. 16 depicts an example assembly of an example clamp bar and an example cable termination bar according to example embodiments of the present disclosure.

FIG. 14 depicts a perspective view of an example clamp bar 152 according to example embodiments of the present disclosure. FIG. 15 depicts a perspective view of an example cable termination bar 154 according to example embodiments of the present disclosure. FIG. 16 depicts an example assembly of an example clamp bar 152 and an example cable termination bar 154 together to form a clamp bar assembly 150. The clamp bar assembly 150 can be installed along the side portions of the vibratory machine. For instance, the cable termination bar 154 can rest along a side frame members of the vibratory machine. The clamp bar 152 can be secured to side wall of the vibratory machine using, for instance, bolts or other suitable means.

As shown in FIG. 14, the clamp bar 152 can include apertures 162 spaced at regular intervals and apertures 164 spaced at regular intervals. Cables and/or portions of the panel fastening shrouds 120 can pass through apertures 162. Cables and/or portions of the panel locating shrouds can pass through apertures 164.

As shown in FIG. 15, the cable termination bar 154 can include slots 156 and slots 158. Slots 156 can be spaced apart at regular intervals and can be configured to receive cables extending through the panel fastening shrouds 120. For instance, a ferrule at the end of a cable can be secured to slot 156 to secure the cable to the cable termination bar 154. Slots 158 can be spaced apart at regular intervals and can be configured to receive cables extending through the panel locating shrouds 130. For instance, a ferrule at the end of a cable can be secured to slot 158 to secure the cable to the cable termination bar 154.

The panel fastening shrouds 120 and the panel locating shrouds 130 can be tensioned across the bucker bar covers by tightening components (e.g., bolts) to secure the clamp bar 152 against the side wall of the vibratory machine. For instance, bolts passing through apertures 166 defined in the clamp bar 152 can be tightened to secure the clamp bar to the side wall of the vibratory machine and tension the panel fastening shrouds 120 and/or the panel location shrouds 130 across the bucker bar covers 110 in the screening system 100.

Figure 17:
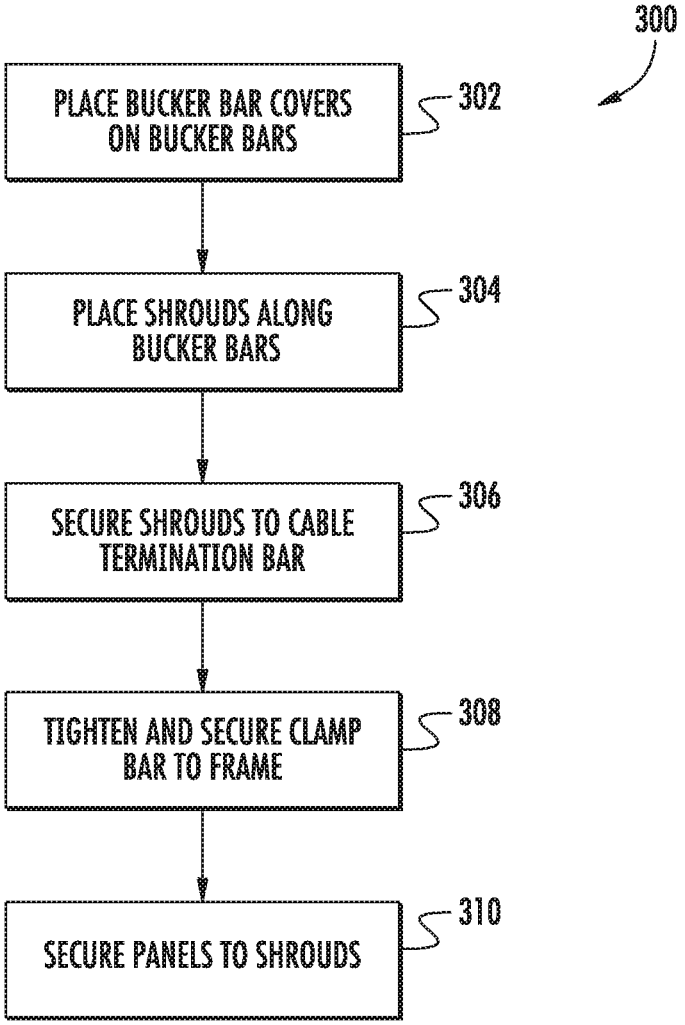
FIG. 17 depicts a flow diagram of an example method according to example embodiments of the present disclosure.

FIG. 17 depicts a flow diagram of an example method (300) of installing a screening system according to example embodiments of the present disclosure. FIG. 17 depicts steps performed in a particular order for purposes of illustration and discussion. Those of ordinary skill in the art, using the disclosures provided herein, will understand that any of the steps of any of the methods disclosed herein can be adapted, modified, expanded, rearranged, and/or omitted without deviating from the scope of the present disclosure.

The method (300) can be performed after removing a woven wire mesh from the vibratory machine. At (302) the method can include placing bucker bar covers on the bucker bars of the vibratory machine. At (304), the shrouds can be placed across the bucker bar covers. For instance, one or more panel fastening shrouds and/or panel locating shrouds can be placed across the bucker bar covers. At (306), the shrouds can be secured to the cable termination bar of a clamp bar assembly. For instance, ferrules at the end of cables passing through the shrouds can be secured to slots in the cable termination bar. At (308), the clamp bar portion of the clamp bar assembly can be tightened and secured to the side wall of the vibratory machine. At (310), one or more modular screen panels can be installed on the shrouds.

Figure 18:
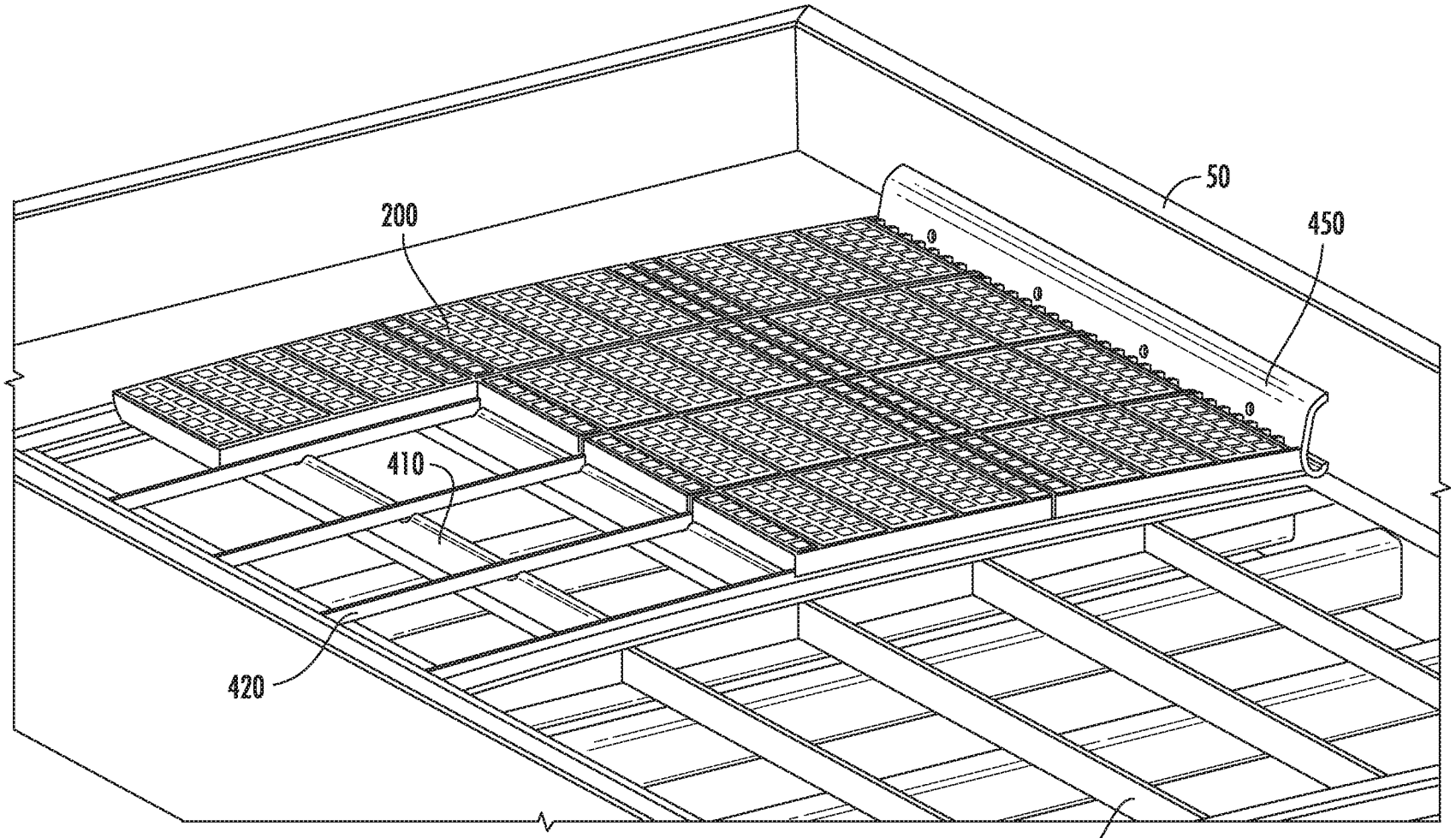
FIG. 18 depicts an perspective view of an example screening system according to example embodiments of the present disclosure.

FIG. 18 depicts an example screening system 400 installed on a vibratory machine 50 according to another example embodiment of the present disclosure. The screening system 400 can be installed or retrofit into the vibratory machine 50 without requiring modification of a frame portion of the vibratory machine 50. For instance, a woven wire mesh can be removed from the vibratory machine 50. Bucker bar covers associated with the woven wire mesh can also be removed. The screening system 400 can be installed into the vibratory machine 50. The screening system 400 can accommodate modular screen panels 200 to provide a modular screening system.

The screening system 400 includes a plurality of bucker bar covers 410, a plurality of panel fastening straps 420, a clamp bar assembly 450, and a plurality of screen panels 200. The panel fastening straps 420 can provide fastening features at regularly spaced intervals for fastening the screen panels 200 to the screening system 400. The screen panels 200 can be used to separate and size material. The screen panels 200 can be made of or can include any suitable material, such as a resilient material (e.g., rubber or polymeric material such as polyurethane.) In some embodiments, the screen panels 200 can be a screen panel depicted in FIG. 6 or 7 or any other suitable screen panel.

As shown in FIG. 18, the bucker bar covers 410 are installed to fit over the bucker bars 52 of the vibratory machine 50. The panel fastening straps 420 extend over the bucker bar covers in a generally perpendicularly direction relative to the bucker bar covers 410. The panel fastening straps 420 can be secured to clamp bar assembly 450 to tension the panel fastening straps 420 in the screening system 400. The screen panels 200 can then be installed in the system 400 using fastening features (e.g., rails) located on the panel fastening straps 420.

Figure 19:
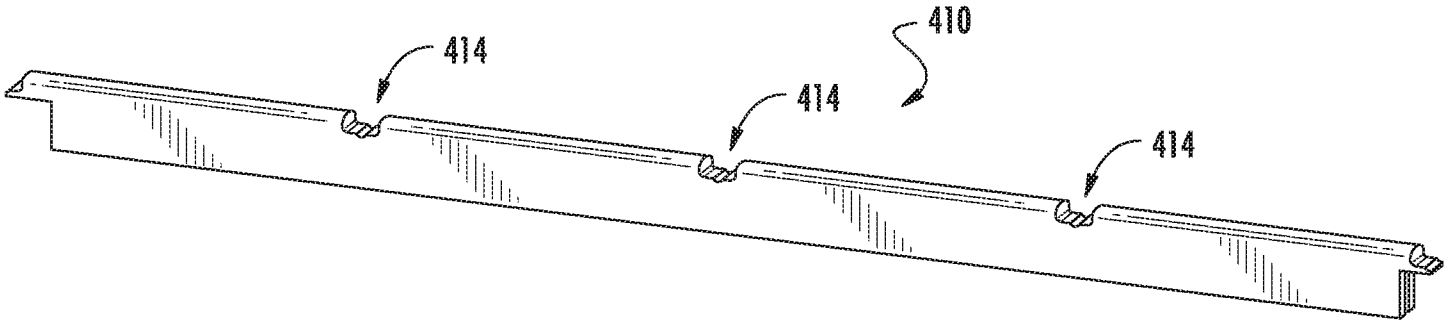
FIG. 19 depicts a perspective view of an example bucker bar cover according to example embodiments of the present disclosure.

FIG. 19 provides a perspective view of an example bucker bar cover 410 according to example embodiments of the present disclosure. The bucker bar cover 410 can be made of any suitable material, such as rubber, polymeric material such as polyurethane, or other material. As shown, the bucker bar cover 410 has a slot having a size and shape adapted to fit over or receive a bucker bar of a vibratory machine. In addition, the bucker bar cover 410 can include fastening strap recesses 414 at regularly spaced intervals along a length of the bucker bar cover 410. The fastening strap recesses 414 can be designed to accommodate a portion of panel fastening strap 420 according to example embodiments of the present disclosure. The spacing between the fastening shroud recesses 414 can be precisely determined to provide regular spacing of the panel fastening straps 420 in the screening system 400 at a desired interval to accommodate dimensions of the screen panels.

Similar to the embodiment of FIG. 1, the screening system 400 of FIG. 18 can, in some embodiments, additionally include panel locating straps. In these embodiments, the bucker bar cover 410 can further include locating strap recesses (not shown) spaced at regular intervals along the length of the bucker bar cover 410. The locating strap recesses can be spaced between the fastening strap recesses 414.

Figure 20:
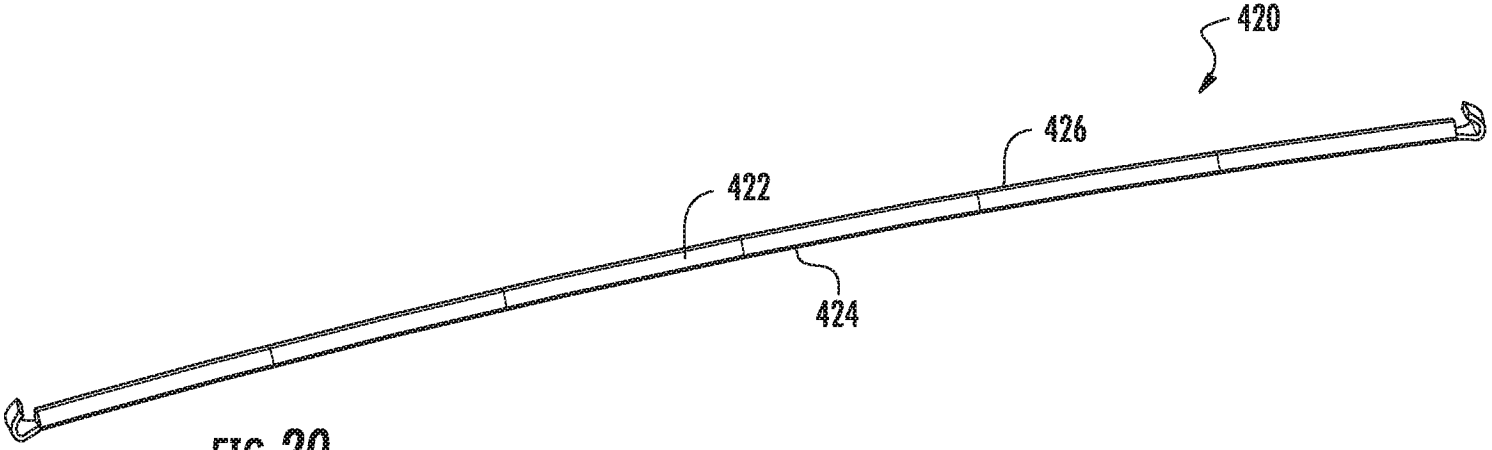
FIG. 20 depicts a perspective view of an example panel fastening strap according to example embodiments of the present disclosure.

FIG. 20 depicts a perspective view of an example panel fastening strap 420 according to example embodiments of the present disclosure. The panel fastening strap 420 can include a strap component 424. The strap component 424 can be formed at least in part of a metal (e.g., steel) and can extend across the bucker bar covers 410 when installed in the screening system. The panel fastening strap 420 can further include a fastening component 422. The fastening component 422 can be, for instance, a resilient material, such as rubber or polyurethane. The fastening component 422 can include a fastening feature 426, such as a rail fastening feature, that can be used to secure screen panels 200 to the screening system 400. The fastening feature 426 may or may not be continuous over the length of the panel fastening strap 420.

Figure 21:
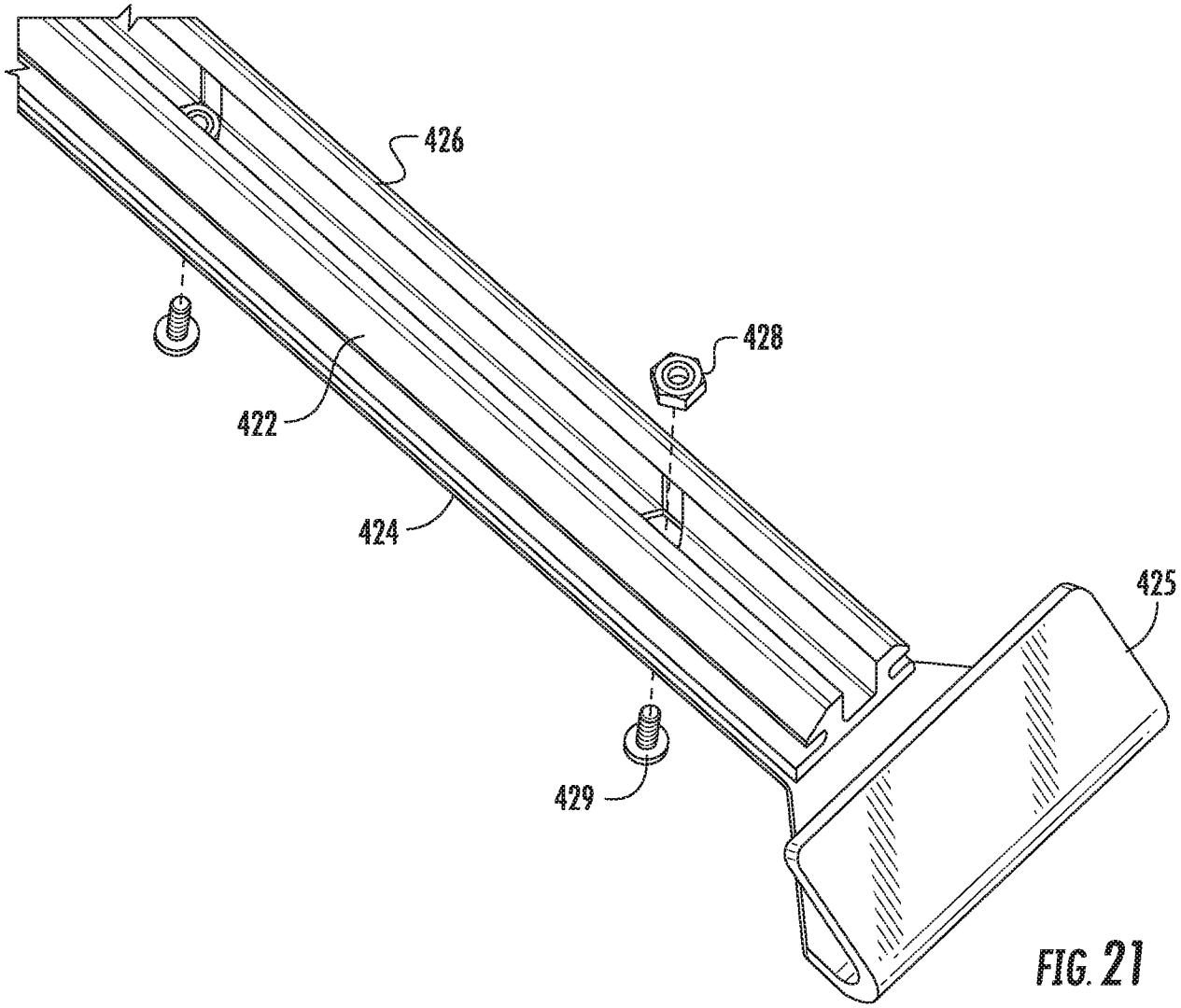
FIG. 21 depicts a close up perspective view of a portion of an example panel fastening strap according to example embodiments of the present disclosure.

FIG. 21 depicts a close up perspective view of an example panel fastening strap 420 according to example embodiments of the present disclosure. As shown, the panel fastening strap 420 has a fastening component 422 with panel fastening feature 426. In this example, the panel fastening feature 426 is a rail having a protrusion extending along a length of the panel fastening strap 420. The protrusion of the panel fastening feature 426 can have any suitable geometry. Those of ordinary skill in the art, using the disclosures provided herein, will understand that other panel fastening features can be used without deviating from the scope of the present disclosure.

The fastening component 422 can be secured to a strap component 424 via a suitable attachment mechanism, such as a nut 428 and bolt 429 or other suitable attachment mechanism. The strap component 424 can included an interface 425 for engaging and tensioning the panel fastening strap 420 to the screening assembly 400. The interface 425 can be configured to cooperate with a clamp bar assembly 450 to secure the fastening straps 420 to the vibratory machine 50. In the example embodiment shown in FIG. 21, the interface 425 includes a hook formed in an end portion of the strap component 424.

Figure 22:
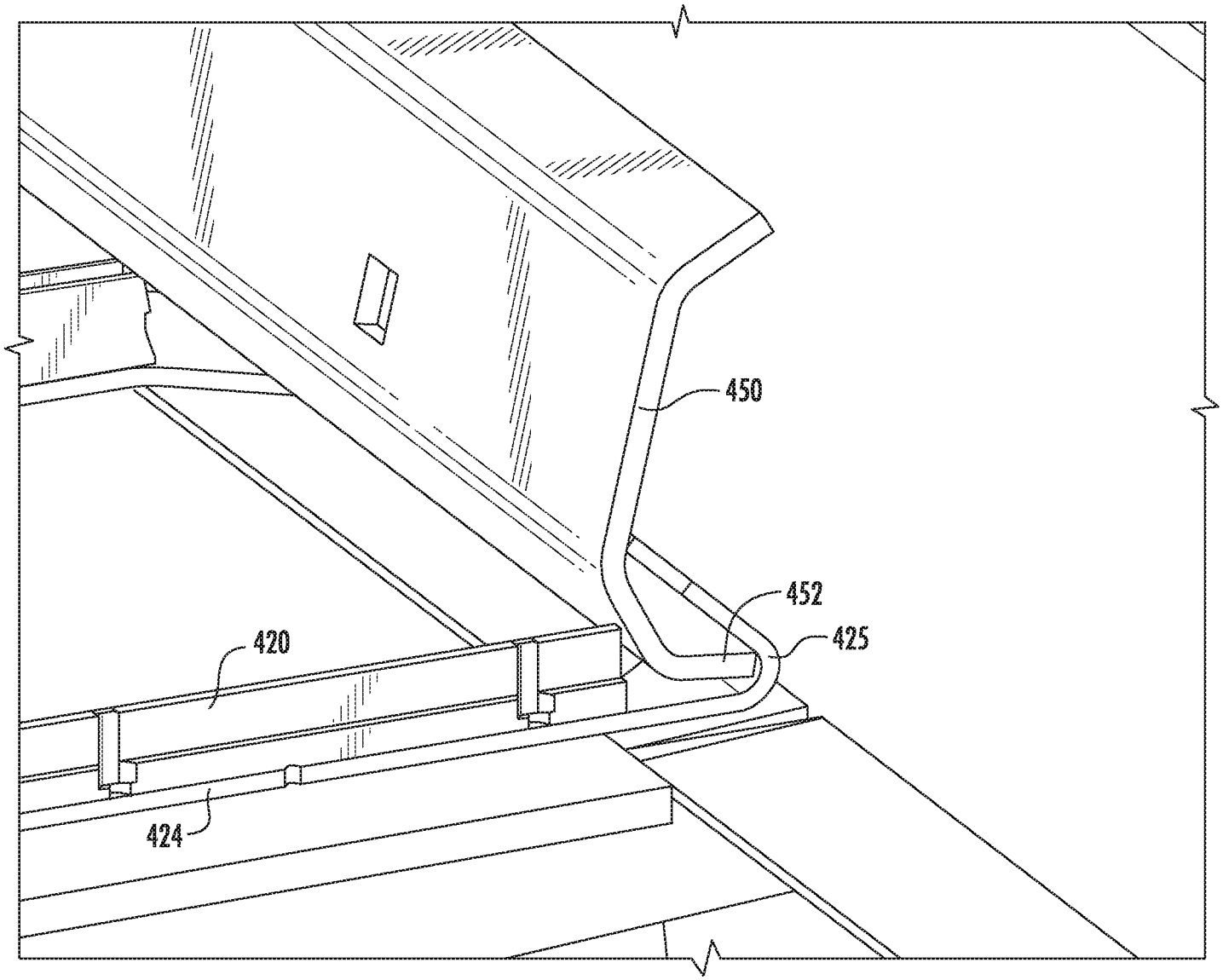
FIG. 22 depicts example engagement between a panel fastening strap and a clamp bar assembly according to example embodiments of the present disclosure.

As shown in FIG. 22, the hook 425 can cooperate with a lip 452 formed in the clamp bar assembly 450 to secure the panel fastening strap 420 to the clamp bar assembly 450. The clamp bar assembly 450 can be secured (e.g., through bolts or other components) to a sidewall of a vibratory machine to tension the panel fastening strap 420.

Figure 23:
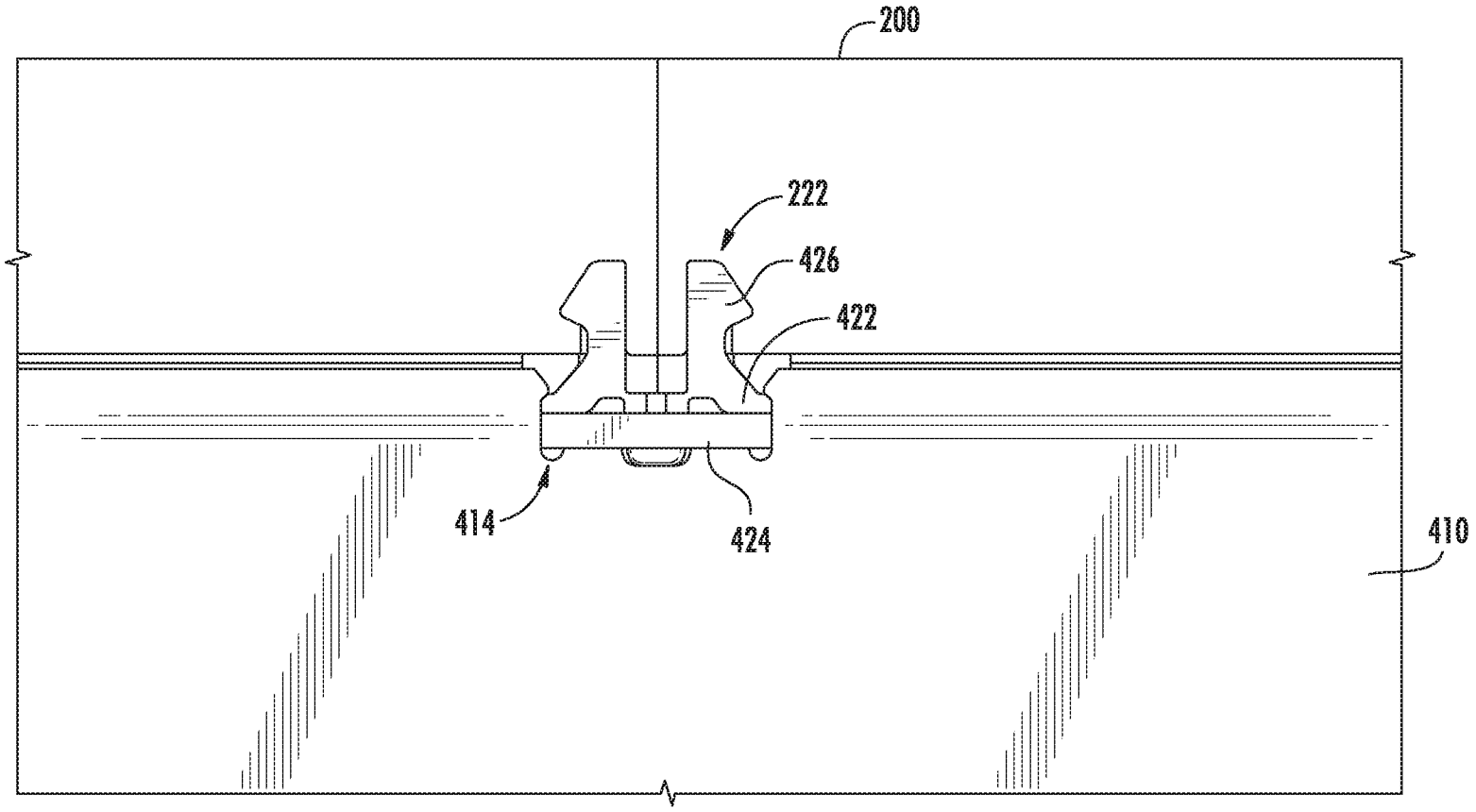
FIG. 23 depicts portions of example screen panels being fastened to an example panel fastening strap according to example embodiments of the present disclosure.

FIG. 23 depicts screen panels 200 engaged with the panel fastening strap 420 to provide a screening surface for the vibratory machine 50. The screen panels 200 can be, for instance, similar to the screen panel 200 described in detail with reference to FIG. 6. As shown, the screen panels 200 can include a fastening recess 222 that extends along a length of an edge member of the screen panel 200 that cooperate and/or engages the fastening feature 426 of the panel fastening strap 420 to secure the screen panel 200 to the system 400. The size and shape of the recess 222 can be configured to receive the fastening feature 426 of the panel fastening strap 420. More particularly, the fastening recess 222 can have a shape and configuration adapted to cooperate with a fastening feature 426 of the panel fastening strap 420. As shown in FIG. 23, two screen panels 200 can be engaged in edge-to-edge relationship along the panel fastening strap 420 to provide a screening surface. The panel fastening strap 420 extends across a recess formed in the bucker bar cover 410 as discussed above.

In some embodiments, the panel fastening strap 420 can include a lateral retention feature (not shown). The lateral retention feature can include a recess and a protrusion that is smaller in dimension relative to the fastening feature 426. The lateral retention feature can extend across a length of the panel fastening strap 420. In addition, the panel fastening strap 420 can include multiple lateral retention features spaced apart across the length of the panel fastening strap 420.

Figure 24:
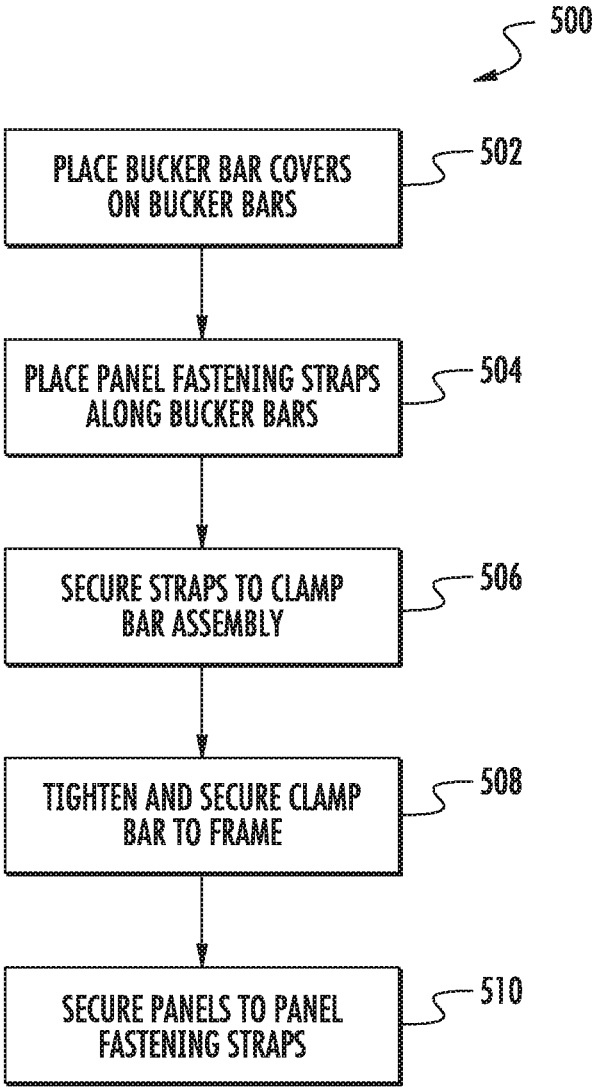
FIG. 24 depicts a flow diagram of an example method according to example embodiments of the present disclosure.

FIG. 24 depicts a flow diagram of an example method (500) of installing a screening system according to example embodiments of the present disclosure. The method (500) can be performed after removing a woven wire mesh from the vibratory machine. At (502) the method can include placing bucker bar covers on the bucker bars of the vibratory machine. At (504), panel fastening straps can be placed across the bucker bar covers. At (506), the panel fastening straps can be secured to a clamp bar assembly. For instance, a hook portion at the end of the panel fastening straps can be secured to lips in the clamp bar assembly. At (508), the clamp bar portion of the clamp bar assembly can be tightened and secured to the side wall of the vibratory machine. At (510), one or more modular screen panels can be installed on the panel fastening straps.

Figure 25:
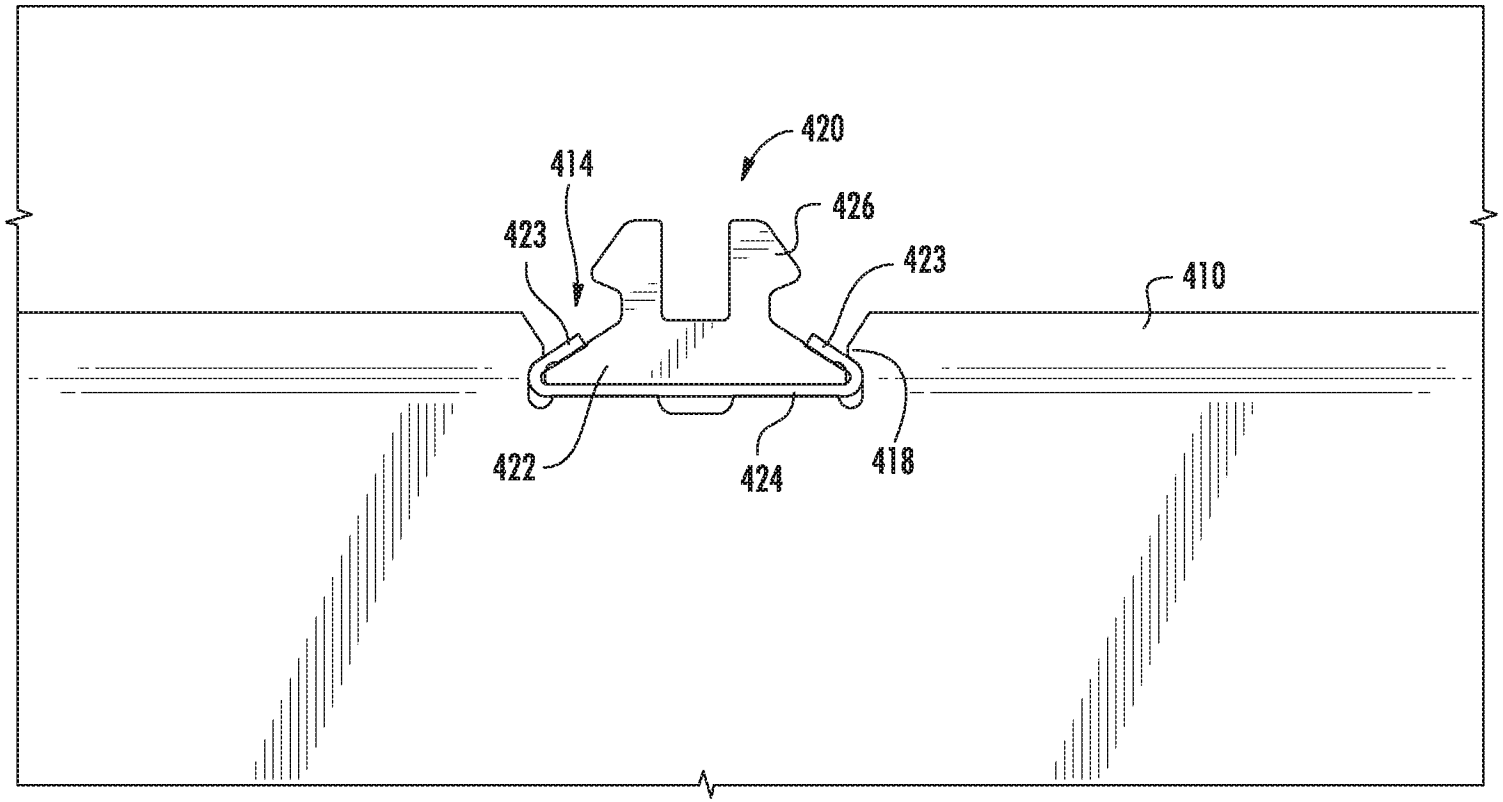
FIG. 25 depicts a panel fastening strap according to example embodiments of the present disclosure.

FIG. 25 depicts a cross-sectional view of a panel fastening strap 420 according to another example embodiment of the present disclosure. The panel fastening strap 420 is extending across a recess 414 formed in a bucker bar cover 410. Similar to the panel fastening strap 420 of FIGS. 21-23, the panel fastening strap 420 includes a metal strap portion 424 and a fastening component 426. The metal strap portion 424 can include, for instance, a metal such as steel. The fastening component 422 can include a metal (e.g. steel) or polymeric material (e.g., polyurethane) and can include a fastening feature 426, such as a rail fastening feature. As shown in FIG. 25, the metal strap portion 424 can include edges 423 that extend upward and inward to encapsulate at least a portion of the fastening component 422. This can facilitate securing the fastening component 422 to the strap portion 424. In addition, the edges 423 can provide additional engagement with the bucker bar cover 410. For instance, the edges 423 can cooperate with a lip 418 defined proximate a recess 414 in the bucker bar cover 410.

Figure 26:
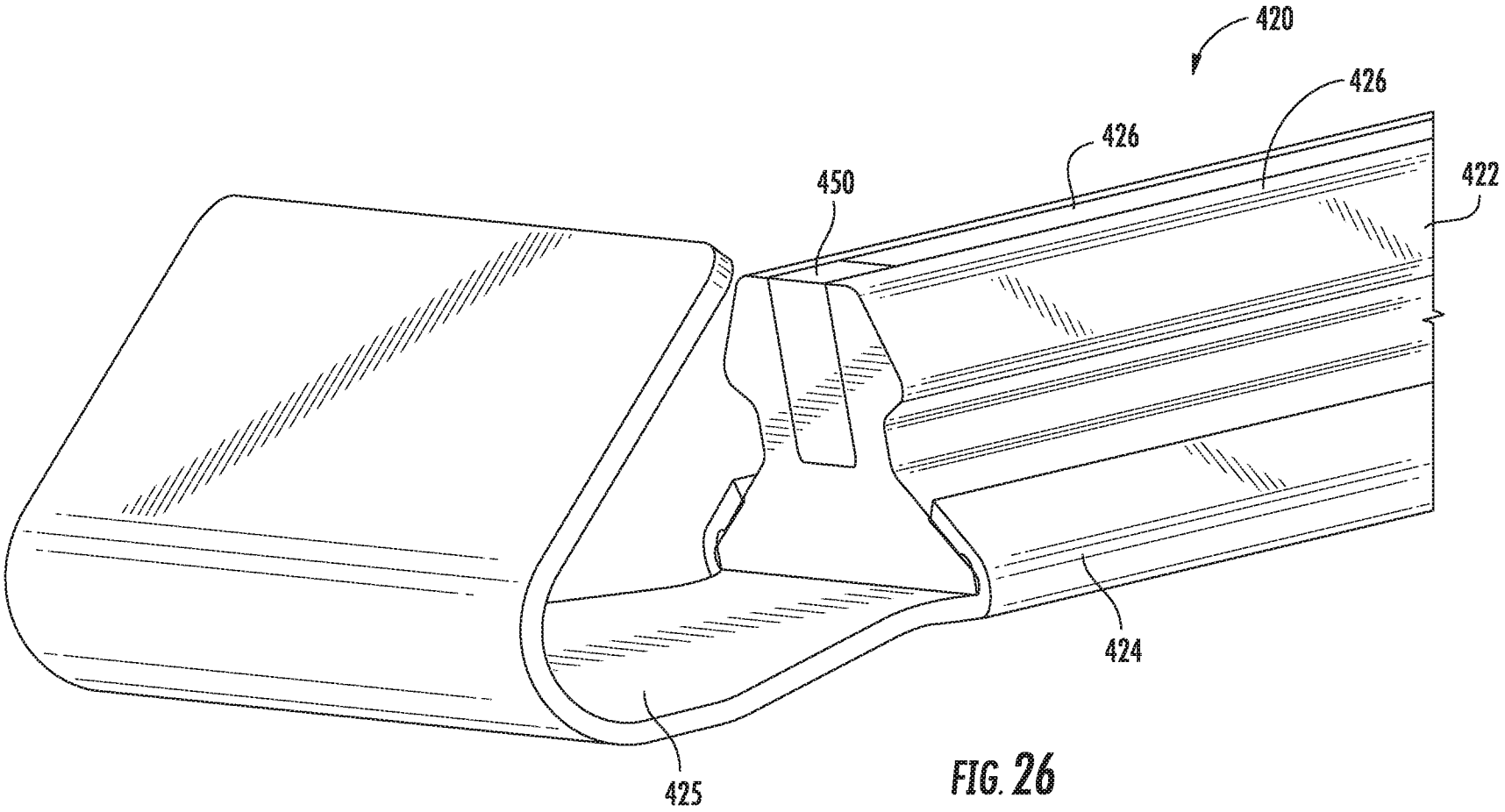
FIG. 26 depicts a close up perspective view of a portion of an example panel fastening strap according to example embodiments of the present disclosure.

FIG. 26 depicts a close up perspective view of a portion of a panel fastening strap 420 according to another example embodiment of the present disclosure. The panel fastening strap 420 includes a metal strap portion 424 and a fastening component 422 formed from, for instance, a molded polymeric material (e.g., polyurethane). The fastening component 422 can include a fastening feature 426 (e.g. a rail fastening feature) for engagement with one or more recesses defined in screen panels. The metal strap portion 424 can include a hook 425 for engagement with a clamp bar assembly to secure the metal strap portion 424 to a vibratory machine.

The panel fastening strap 420 additionally includes a male panel stop 450 located in the center portion of the fastening component 422. More particularly, the male panel stop 450 is located in a recess defined between two rail fastening features 426 of the fastening component 422. The male panel stop 426 can have any suitable shape. A single male panel stop 450 located at an end portion of the fastening component 422 is depicted in FIG. 26 for purposes of illustration and discussion. Any number of single male panel stops 450 can be spaced along the fastening component 422 at regular intervals (e.g., corresponding to panel lengths) without deviating from the scope of the present disclosure.

Figure 27:
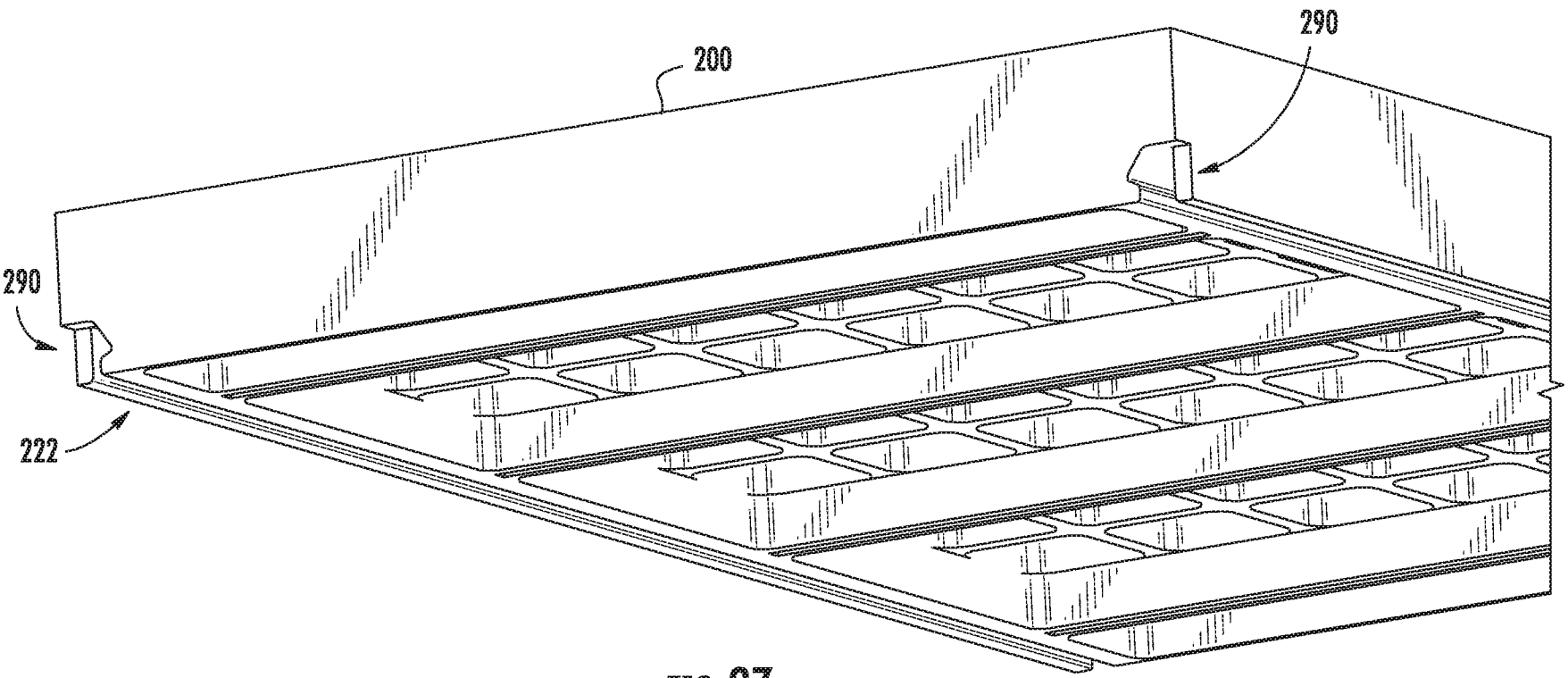
FIG. 27 depicts a screen panel according to example embodiments of the present disclosure.

As shown in FIG. 27, a screen panel 200 can include a corresponding female mating feature 290 at an end portion of the screen panel 200. The female mating feature 290 has a shape and size adapted to engage with the male panel stop 450 locating on the fastening component 422 when the screen panel 200 is installed in the screening system. The male panel stop 450 can cooperate with the female mating feature 290 to reduce movement of the screen panels 200 when installed in the screening system on the vibratory machine. FIG. 27 illustrates the female mating feature 290 located at an end portion of a fastening recess 222. The female mating feature 290 can be located at other positions along the fastening recess 222 at regular intervals to accommodate dimensions of the screen panels (e.g., corresponding to panel lengths) without deviating from the scope of the present disclosure.

Figure 28:
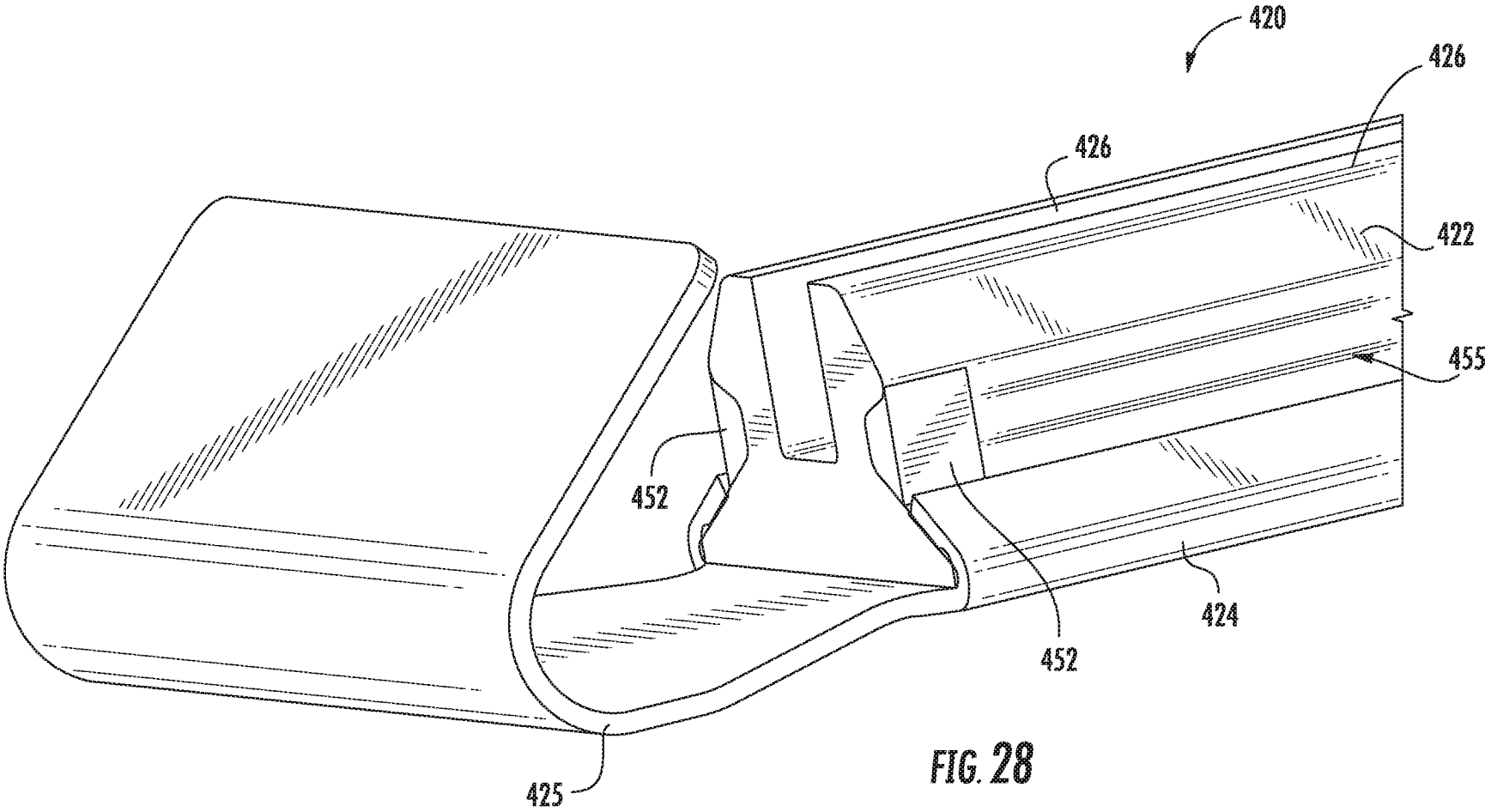
FIG. 28 depicts a close up perspective view of a portion of an example panel fastening strap according to example embodiments of the present disclosure.

FIG. 28 depicts a close up perspective view of a portion of a panel fastening strap 420 according to another example embodiment of the present disclosure. The panel fastening strap 420 includes a metal strap portion 424 and a fastening component 422 formed from, for instance, a molded polymeric material (e.g., polyurethane). The fastening component 422 can include a fastening feature 426 (e.g. a rail fastening feature) for engagement with one or more recesses defined in screen panels. The metal strap portion 424 can include a hook 425 for engagement with a clamp bar assembly to secure the metal strap portion 424 to a vibratory machine. The panel fastening strap may also be formed from a single material, either metal or polymeric material, either of which could be molded, forged, cast, or extruded, for instance.

The panel fastening strap 420 additionally includes a plurality of male panel stops 452 located in an outer portion of the fastening component 422. More particularly, each rail fastening feature 426 includes its own respective male panel stop 452 located in a cavity defined on an outer edge of the rail fastening features 426 of the fastening component 422. Two male panel stops 452 located at end portions of the fastening features 426 are illustrated for purposes of illustration and discussion. Any number of male panel stops 452 can be spaced along each fastening feature 426 at regular intervals to accommodate dimensions of the screen panels (e.g., corresponding to panel lengths) without deviating from the scope of the present disclosure.

Figure 29:
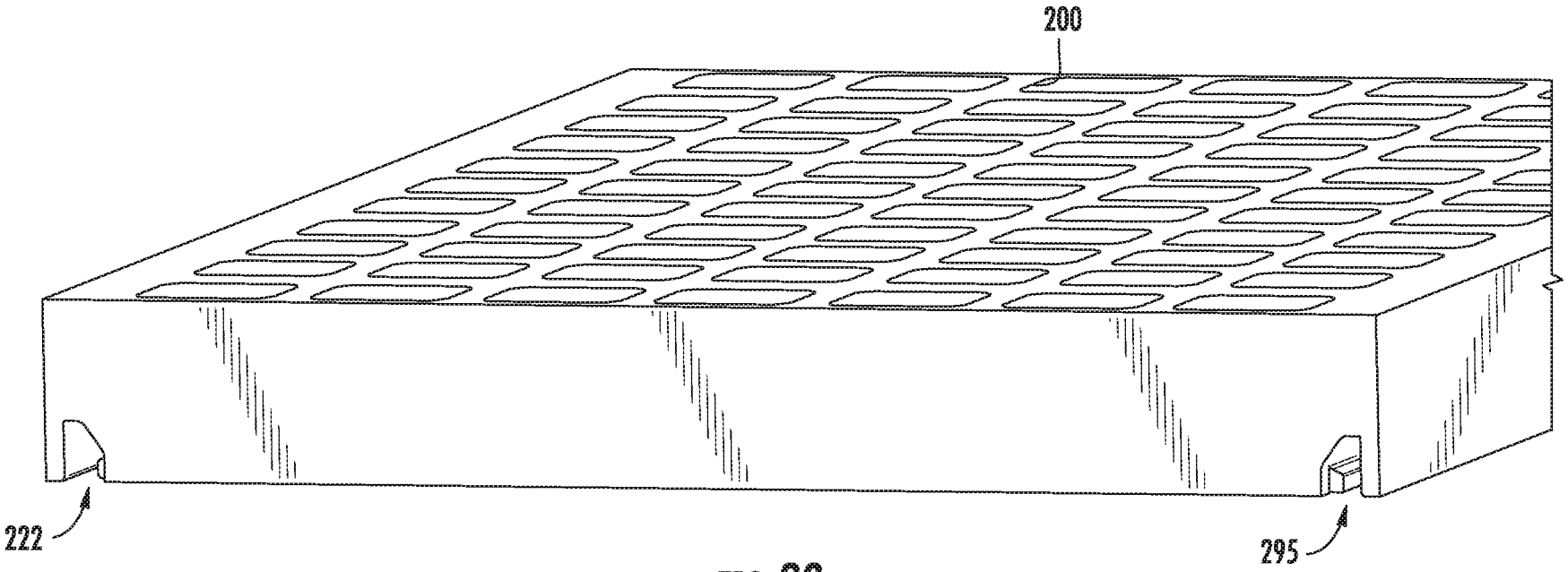
FIG. 29 depicts a screen panel according to example embodiments of the present disclosure.

As shown in FIG. 29, a screen panel 200 can include a corresponding female mating feature 295 at an end portion of the fastening recess 222 screen panel 200. Each female mating feature 295 has a shape and size adapted to engage with the male panel stop 452 locating on a fastening feature 426 when the screen panel 200 is installed in the screening system. The male panel stop 452 can cooperate with the female mating feature 295 to reduce movement of the screen panel 200 when installed in the screening system on the vibratory machine. FIG. 29, illustrates the female mating feature 295 located at an end portion of a fastening recess 222. The female mating feature 295 can be located at other positions along the fastening recess 222 without deviating from the scope of the present disclosure.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A screening system for a portable vibratory machine, the portable vibratory machine having a plurality of bucker bars, the screening system comprising:

a plurality of bucker bar covers, each of the bucker bar covers adapted to fit over one of the plurality of bucker bars of the portable vibratory machine, each of the bucker bar covers comprising a plurality of recesses;

a plurality of panel fastening members, each of the panel fastening members adapted to extend across the plurality of bucker bar covers, each of the panel fastening members positioned on the bucker bar covers such that a portion of each of the panel fastening members is positioned within a corresponding recess of the plurality of recesses; and a plurality of screen panels, each of the screen panels coupled to a corresponding panel fastening member of the plurality of panel fastening members, each of the screen panels having a plurality of support ribs extending in a perpendicular relationship to edge members of each of the screen panels;

wherein each screen panel defines a thin portion between at least one edge member of the screen panel and a fastening recess in the screen panel, the thin portion comprising a rubber material or a polymeric material; and wherein each screen panel comprises a metal insert formed in each of the plurality of support ribs, the metal insert having a lip portion that extends at least partially into the thin portion defined between the at least one edge member of the screen panel and the fastening recess in the screen panel to provide structural support for the thin portion.

2. The screening system of claim 1, wherein the screening system further comprises a clamp bar assembly, the plurality of panel fastening members configured to be secured to the clamp bar assembly.

3. The screening system of claim 2, wherein the clamp bar assembly is secured to a frame of the portable vibratory machine to tension the panel fastening members over the plurality of bucker bar covers.

4. The screening system of claim 1, wherein each of the plurality of panel fastening members comprise a panel fastening shroud, the panel fastening shroud having a tube, the screening system comprising a cable extending through the tube of the panel fastening shroud.

5. The screening system of claim 1, wherein the plurality of panel fastening members comprises a panel fastening strap.

6. The screening system of claim 5, wherein the panel fastening strap comprises a metal strap portion and a fastening component, wherein the fastening component comprises a fastening feature, the fastening component formed of a polymeric material.

7. The screening system of claim 6, wherein the metal strap portion has a hook for engagement with a clamp bar assembly.

8. The screening system of claim 6, wherein the metal strap portion comprises at least one edge that extends upward and inward to encapsulate at least a portion of the fastening component.

9. The screening system of claim 6, wherein the panel fastening strap comprises at least one male panel stop.

10. The screening system of claim 6, wherein the fastening feature comprises a rail fastening feature.

11. The screening system of claim 1, wherein at least one panel fastening member comprises a lateral retention feature configured to engage with a lateral retention feature on one of the plurality of screen panels.

12. The screening system of claim 9, wherein at least one of the plurality of screen panels comprises a female mating feature having a shape and size adapted to engage with the male panel stop.

13. The screening system of claim 1, wherein one or more of the plurality of screen panels comprise:

a peripheral frame comprising a pair of opposing edge members and a pair of opposing side members;

a screening surface extending between the pair of opposing edge members and the pair of opposing side members, the screening surface comprising a rubber material or a polymeric material;

the fastening recess defined along at least a portion of one edge member of the pair of opposing edge members; and a portion defined between the fastening recess and one of the opposing edge members or one of the opposing side members, the portion comprising a rubber material or a polymeric material;

wherein the fastening recess has a shape adapted to engage with a fastening feature of a corresponding panel fastening member of the plurality of panel fastening members, wherein each of the one or more screen panels further comprises a lateral retention groove extending across at least a portion of the screen panel, the lateral retention groove being smaller in at least one dimension relative to the fastening recess; and wherein the one or more screen panels comprises one or more metal inserts having a lip portion that extends into the portion defined between the fastening recess and one of the opposing edge members or one of the opposing side members to provide structural support for the portion defined between one of the opposing edge members or one of the opposing side members.

14. A screening system for a portable vibratory machine, the portable vibratory machine having a plurality of bucker bars, the screening system comprising:

a plurality of bucker bar covers, each of the bucker bar covers adapted to fit over one of the plurality of bucker bars of the portable vibratory machine, each of the bucker bar covers comprising a plurality of recesses;

a plurality of panel fastening members, each of the panel fastening members adapted to extend across the plurality of bucker bar covers, each of the panel fastening members positioned on the bucker bar covers such that a portion of each of the panel fastening members is positioned within a corresponding fastening member recess of the plurality of recesses;

a plurality of panel locating members, each of the panel locating members adapted to extend across the plurality of bucker bar covers, each of the panel locating members positioned on the bucker bar covers such that a portion of each of the panel locating members is positioned within a corresponding locating member recess of the plurality of recesses;

a plurality of screen panels, one or more of the plurality of screen panels comprising:

a peripheral frame comprising a pair of opposing edge members and a pair of opposing side members;

a fastening recess defined along at least a portion of one edge member of the pair of opposing edge members, the fastening recess having a shape adapted to couple to a corresponding panel fastening member of the plurality of panel fastening members; and a locating recess defined along at least a portion of one side member of the pair of opposing side members, the locating recess having a shape adapted to couple to a corresponding panel locating member of the plurality of panel locating members.

* * * * *